US012458098B2

(12) United States Patent
Guglielmo et al.

(10) Patent No.: US 12,458,098 B2
(45) Date of Patent: Nov. 4, 2025

(54) ADJUSTABLE SHIELD FOR HELMET

(71) Applicant: Oakley, Inc., Foothill Ranch, CA (US)

(72) Inventors: Brett Guglielmo, Fullerton, CA (US); Chad Mckonly, Irvine, CA (US)

(73) Assignee: Oakley, Inc., Foothill Ranch, CA (US)

( * ) Notice: Subject to any disclaimer, the term of this patent is extended or adjusted under 35 U.S.C. 154(b) by 136 days.

(21) Appl. No.: 17/978,574

(22) Filed: Nov. 1, 2022

(65) Prior Publication Data

US 2023/0137423 A1 May 4, 2023

Related U.S. Application Data

(60) Provisional application No. 63/274,760, filed on Nov. 2, 2021.

(51) Int. Cl.
*A42B 3/20* (2006.01)

(52) U.S. Cl.
CPC ..... *A42B 3/20* (2013.01)

(58) Field of Classification Search
CPC ..... A42B 3/04; A42B 3/0406; A42B 3/185; A42B 3/20; A42B 3/221; A42B 3/222; A42B 3/223; A42B 3/226; A42B 3/326
USPC ..... 2/9
See application file for complete search history.

(56) References Cited

U.S. PATENT DOCUMENTS 5,185,889 A * 2/1993 Kamata ..... A42B 3/222 2/424
5,461,731 A * 10/1995 Shida ..... A42B 3/222 2/424
6,490,729 B1 12/2002 Dondero
6,603,222 B2 8/2003 Loges
6,892,393 B1 5/2005 Provost et al.
8,474,108 B2 7/2013 Eisenberger
8,555,423 B2 10/2013 Giroux et al.
8,800,117 B2 8/2014 Fiedler
(Continued)

FOREIGN PATENT DOCUMENTS

CN 200947836 Y 9/2007
CN 207322781 U 5/2018
(Continued)

OTHER PUBLICATIONS

International Search Report and Written Opinion of the International Searching Authority directed to related International Patent Application No. PCT/US2022/048506, mailed Jan. 25, 2023; 16 pages.

(Continued)

*Primary Examiner* — Jameson D Collier
*Assistant Examiner* — Matthew R Marchewka
(74) *Attorney, Agent, or Firm* — Sterne, Kessler, Goldstein & Fox P.L.L.C.

(57) ABSTRACT

A face shield adjustment system is provided. A helmet and face shield can be attached such that the face shield is in an as-worn position. The face shield can be moved between a first secured position at a first distance from the eyes of the wearer in an as-worn position and a second secured position at a second distance from the eyes of the wearer in the as-worn position. The secured positions can fix the face shield relative to the eyes of the wearer and/or the helmet by an engagement between teeth of a helmet frame and teeth of a slider, where the slider is attached to the face shield.

26 Claims, 17 Drawing Sheets

(56) References Cited

U.S. PATENT DOCUMENTS

| | | | | |
|---|---|---|---|---|
| 9,155,347 | B2 | 10/2015 | Waes | |
| 9,494,177 | B2 | 11/2016 | Fuhrman et al. | |
| 9,539,144 | B2 | 1/2017 | Dunleavy et al. | |
| 9,572,410 | B2 | 2/2017 | Fiedler | |
| 9,585,445 | B2 | 3/2017 | Qian et al. | |
| 9,743,703 | B2 | 8/2017 | Gotti | |
| 10,070,677 | B2 | 9/2018 | Durham et al. | |
| 10,145,450 | B2 | 12/2018 | Moore et al. | |
| 10,154,704 | B1 | 12/2018 | Caito, III | |
| 10,159,603 | B2 | 12/2018 | Rees et al. | |
| 10,327,490 | B2 | 6/2019 | Pevenstein | |
| 10,456,299 | B2 | 10/2019 | Hilton et al. | |
| 10,627,783 | B2 | 4/2020 | Rothkopf et al. | |
| 10,703,429 | B2 | 7/2020 | Fiedler et al. | |
| 10,722,005 | B1 | 7/2020 | DiPietro | |
| 10,757,995 | B2 | 9/2020 | Jacobsen | |
| 2004/0046930 | A1 | 3/2004 | Brzozowski | |
| 2005/0183190 | A1 | 8/2005 | Hussey | |
| 2009/0195747 | A1 | 8/2009 | Insua | |
| 2010/0005558 | A1* | 1/2010 | Lee | A42B 3/223 2/15 |
| 2010/0154093 | A1* | 6/2010 | Provost | A42B 3/185 2/13 |
| 2011/0072564 | A1 | 3/2011 | Krauter | |
| 2011/0094019 | A1* | 4/2011 | Isobe | A42B 3/222 2/424 |
| 2013/0185901 | A1 | 7/2013 | Heyman et al. | |
| 2014/0245523 | A1 | 9/2014 | Teetzel et al. | |
| 2014/0283826 | A1 | 9/2014 | Murray et al. | |
| 2014/0317890 | A1 | 10/2014 | Koons et al. | |
| 2015/0216269 | A1 | 8/2015 | Fuhrman et al. | |
| 2017/0273385 | A1 | 9/2017 | Scheller | |
| 2017/0325534 | A1* | 11/2017 | Noordzij | A42B 3/223 |
| 2019/0037979 | A1 | 2/2019 | Diner et al. | |
| 2019/0177983 | A1 | 6/2019 | Klein | |
| 2019/0261711 | A1 | 8/2019 | Yarger | |
| 2019/0365009 | A1 | 12/2019 | Frieder, III et al. | |
| 2020/0039047 | A1 | 2/2020 | Keister et al. | |

FOREIGN PATENT DOCUMENTS

| | | | |
|---|---|---|---|
| EP | 2741628 | B1 | 6/2015 |
| KR | 101599974 | B1 | 3/2016 |
| WO | 2006034033 | A1 | 3/2006 |
| WO | 2008006355 | A2 | 1/2008 |
| WO | 2008006356 | A2 | 1/2008 |
| WO | 2013112431 | A1 | 8/2013 |
| WO | 2015183171 | A1 | 12/2015 |
| WO | 2016057792 | A1 | 4/2016 |
| WO | 2018033469 | A1 | 2/2018 |

OTHER PUBLICATIONS

European Search Report and Opinion directed to European Patent Application No. 22890663, mailed Jul. 3, 2025; 9 pages.

* cited by examiner

20

20

ADJUSTABLE SHIELD FOR HELMET

CROSS-REFERENCE TO RELATED APPLICATIONS

The present application claims benefit of and priority to U.S. Provisional Patent App. No. 63/274,760, filed Nov. 2, 2021, which is incorporated herein by reference in its entirety for all purposes.

BACKGROUND OF THE INVENTION

Field of the Invention

This present invention relates to helmets and face shields, and more specifically to adjustment of face shields attached to helmets.

Background

Helmets and face shields are used during sporting activities, such as winter sports. Wearers of these products need to protect their heads and eyes from injury or impact, which can be caused by environmental debris and/or harsh conditions. These helmets and face shields can be worn during the entire duration of the activity as well, which can last multiple hours. Accordingly, participants desire helmets and face shields that provide comfort and fit throughout the duration of the activity. Additionally, participants require helmets and face shields that provide comfort and fit to support their performance.

BRIEF SUMMARY OF THE INVENTION

According to aspects, a face shield fit adjustment system can include a frame to attach to a helmet. The frame can include a channel. The face shield fit adjustment system can also include a face shield slider to move within the channel of the frame while in an as-worn position between a first secured position such that a face shield is at a first distance from an eye of a wearer in an as-worn position, and a second secured position such that the face shield is at a second distance from the eye of the wearer in the as-worn position, the first distance being less than the second distance. The face shield fit adjustment system can also include a release to disengage the face shield slider to move the face shield slider between the first secured position and the second secured position.

In an aspect, the face shield slider can be releasably attached to a face shield to adjust the face shield relative to the eye of the wearer.

In an aspect, a helmet can include the face shield fit adjustment system and a face shield. The face shield can be adjusted with the face shield fit adjustment system to fit relative to the eye of the wearer.

In an aspect, the slider can be biased to the first secured position.

In an aspect, the face shield fit adjustment system can further include a frame member attached to the frame to hold the face shield slider in the first secured position and the second secured position. In an aspect, a distance along a longitudinal axis between the first secured position and the second secured position can be less than a length of the frame member. In an aspect, the distance can be in a range of approximately one millimeter to approximately 15 millimeters. In an aspect, the distance can be approximately one millimeter. In an aspect, the frame member can selectively engage teeth integral with the face shield slider in the first secured position and the second secured position. In an aspect, the frame member can include teeth that selectively engage the teeth of the face shield slider in the first secured position and the second secured position.

In an aspect, the face shield fit adjustment system can further include a face shield slider member pivotally attached to the face shield slider at a first end. The teeth of the face shield slider can be part of the face shield slider member. In an aspect, a free end of the face shield slider member can be coupled to the release. In an aspect, the face shield slider member can rotate to move between the first secured position and the second secured position. In an aspect, the face shield slider member can be biased to engage the frame member.

In an aspect, the face shield slider can include a protrusion that moves within the channel of the frame.

In an aspect, the face shield fit adjustment system can further include a second frame attached to the helmet. The second frame can include a second channel. The face shield fit adjustment system can further include a second face shield slider to move within the second channel of the second frame. The face shield slider can move with the second face shield slider between the first secured position and the second secured position.

In an aspect, the release can disengage the first face shield slider and the second face shield slider simultaneously to move the face shield slider between the first secured position and the second secured position.

According to aspects, a face shield attached to a face shield fit adjustment system can include a lens and a frame attached to the lens and to a face shield slider of the face shield fit adjustment system, the face shield slider moving within a channel of a helmet to adjust the lens relative to an eye of a wearer in an as-worn position.

In an aspect, the lens can be fixed in position relative to the eye of the wearer by engagement between the face shield and the helmet.

In an aspect, a lens tilt of the lens can change up to five degrees between a first secured position in the as-worn position and a second secured position in the as-worn position.

In an aspect, the face shield can further include a magnet disposed in a recess of an outrigger of the face shield to attach the face shield to the helmet and a magnet release. The magnet release can move the recess to detach the face shield from the helmet. The magnet release can be biased to not move the recess.

According to aspects, a helmet attached to a face shield fit adjustment system can include an upper shell. The helmet attached to a face shield fit adjustment system can also include a frame attached to the upper shell. The frame can include a channel to receive a face shield slider of the face shield fit adjustment system. The helmet attached to a face shield fit adjustment system can also include a frame member attached to the frame to engage the face shield slider in a first secured position and a second secured position and a lower shell attached to a release of the face shield fit adjustment system. The release can move from a first position to a second position to disengage the frame member from the face shield slider to move the face shield slider in an as-worn position between a first secured position such that a face shield is at a first distance from an eye of a wearer in an as-worn position, and a second secured position such that the face shield is at a second distance from the eye of the wearer in the as-worn position, the second distance greater than the first distance.

In an aspect, a bottom edge of the lower shell can be coplanar with the release in the first position of the release.

In an aspect, the frame member can translate or rotate relative to a longitudinal axis when the release is in its second position.

In an aspect, the frame member can include a top toothed edge to engage the face shield slider.

In an aspect, the channel of the frame can be bounded by a track of the frame to receive an upper end of the face shield slider.

In an aspect, the helmet can further include a first magnetic interface to couple the helmet to a face shield in an engaged position and a second magnetic interface to couple the helmet to the face shield in a stowed position. Each of the first magnetic interface and the second magnetic interface can include a magnet disposed in a recess of the upper shell.

BRIEF DESCRIPTION OF THE DRAWINGS/FIGURES

Some features herein are illustrated by way of example, and not by way of limitation, in the accompanying drawings. In the drawings, like numerals reference similar elements between the drawings.

DETAILED DESCRIPTION OF THE INVENTION

Figure 1:
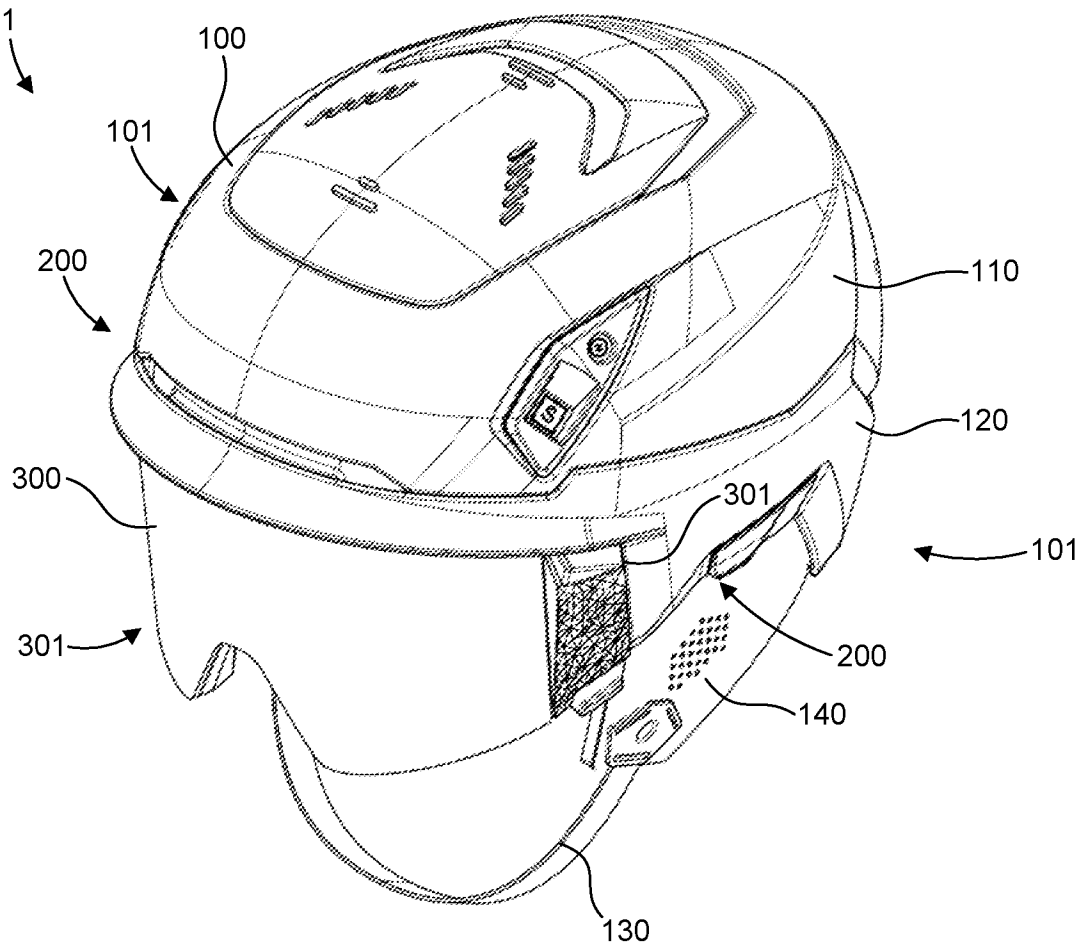
FIG. 1 shows a perspective view of a helmet-shield adjustment system according to aspects.

The present inventions will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present inventions. Other suitable modifications and adaptations of the variety of conditions and parameters normally encountered in the field, and which would be apparent to those skilled in the art, are within the spirit and scope of the inventions.

Axes and planes discussed herein are with reference to a wearer's head in an upright vertical position. The systems and components thereof can be shifted in various activities. Movement of the systems and components thereof can be relative to this positioning. It should be understood that the systems and methods described herein are applicable to adjustment from an anterior positioning to a posterior positioning, from a posterior positioning to an anterior positioning, and between an anterior positioning and a posterior positioning. Reference to a first secured position with a posterior positioning and a second secured position with an anterior positioning do not indicate solely two positions for adjustment, but rather two separate positions within the adjustment range(s) described herein. Additionally, first and second secured positions described herein do not indicate the order of positioning. Accordingly, a second secured position can be set before a first secured position, and vice versa.

Systems and methods are described herein relating to helmet and face shields that provide improved fit and comfort. The face shield can be attached to the helmet and can be adjusted relative to the eyes of the wearer and the helmet while in an as-worn position. Accordingly, the wearer can adjust the face shield while wearing both the helmet and the face shield. The adjustment system can iteratively adjust the position of the face shield to achieve a desired fit. In an aspect, the face shield can correlate to a desired face pressure and/or distance from the eyes. Additionally, the position of the face shield can be selected to maintain a desired performance of the face shield lens. For example, the position of the face shield can be fixed in a first secured position, which can coincide with a posterior positioning where the face shield is closer to the eyes of the wearer and/or the helmet. The face shield can be adjusted to be fixed in a second secured position, which can coincide with an anterior positioning where the face shield is farther from the eyes of the wearer and/or the helmet relative to the posterior positioning. Adjustment can include translation and/or rotation. The system and methods described herein also show engaged and stowed positions of the face shield, where the wearer can stow the face shield on the helmet to keep the helmet and face shield coupled together.

To adjust the position of the face shield lens relative to the helmet and the eyes of the wearer, existing goggles can use straps. The straps can be attached to the goggles and can extend around a wearer's head and/or helmet to secure goggles to the wearer. The strap can be adjusted to fit tighter or looser around the wearer. However, adjustment of the straps can require removing the goggles from the wearer.

Additionally, the wearer might not achieve an ideal adjustment. For example, a wearer might adjust the straps to be too tight or too loose, requiring additional fitting and readjustment. The wearer may settle on a workable configuration, which might not be the best configuration for the wearer. In contrast, fitting a face shield relative to the eyes of the wearer and/or the helmet in an as-worn position can allow the wearer to simultaneously determine and set their ideal face shield placement. This eliminates the inconsistencies inherent in adjustment that requires separation of goggles from a helmet and reduces the time and effort to find a desired fit.

The face shield system described herein can be adjustable and does not require the use of straps. The helmet can include a frame that is part of an adjustment system. The frame can include a channel. A slider, or a pawl, coupled to the face shield can move within the frame channel between secured positions. These positions can secure the face shield relative to the eyes of the wearer and/or the helmet. A release can be attached to the adjustment system to allow the face shield slider to move between different secured positions. In some aspects, the release can be a button or lever disposed on the shell of the helmet and accessible to the wearer from the exterior of the helmet. In some aspects, the adjustment system can include micro-adjustments. In this way, the face shield can be adjusted in small increments (e.g., in millimeters) to achieve a desired fit and performance of the face shield lens.

In some aspects, a strap can be added to the face shield described herein to adapt the face shield to other systems. The face shield can be modular and can function with additional helmet designs.

The adjustment system frame can be fixed to the helmet and can include a frame member. In some aspects, the frame member can have teeth. In some aspects, the teeth can be disposed along a frame member edge, e.g., a top edge. In some aspects, corresponding teeth can be disposed on a portion of the slider. In some aspects, the teeth can be integral with the slider. In some aspects, the slider teeth can be disposed along a bottom edge of a slider member. The slider teeth member and the frame member teeth can engage and disengage to move the face shield between different secured positions relative to the eyes of the wearer and/or the helmet.

In some aspects, the slider member can be pivotally attached to the slider. In an aspect, the slider member can have a pinned end attached to the slider and a free end opposite the pinned end. In some aspects, the free end can be coupled to the release. In an aspect, as the release is actuated, the slider member can be rotated about its pinned end to disengage the slider teeth from the frame member teeth, allowing the slider to move from a secured position. Accordingly, in some aspects, wearer actuation of a release rotates the slider member to disengage the slider member teeth from the frame member teeth. As the release button is actuated, the face shield can move to a desired secured position. Once a desired secured position is achieved, the wearer can let go of the release. The slider member can be biased to rotate such that the slider member teeth engage the frame member teeth, thereby maintaining the face shield in a secured position. Thus, the face shield can be secured as desired by the wearer relative to the eyes of the wearer and/or the helmet without needing to remove the face shield. Additionally, the adjustment system can allow the face shield to be adjusted while remaining in front of the eyes of the wearer such that the wearer can easily select and set desired face shield positioning.

A face shield can include a lens, a frame, and foam to provide an interface between the face shield and the wearer's face. These components can conform to the wearer's face. The face shield can include ends that attach to ends of the helmet. In some aspects, the face shield ends can be adjusted simultaneously. Accordingly, releasing the slider connected on one end can also release the slider at the other end of the face shield such that both ends of the face shield can be adjusted simultaneously. In this way, the wearer can simultaneously adjust the ends of the face shield relative to the eyes of the wearer and/or the helmet. Adjustment of both ends simultaneously can be desirable to facilitate an easier adjustment. This also allows the face shield to be adjusted with one hand. In some aspects, each end of the face shield can be adjusted independently.

Additionally, in some aspects, the face shield can both translate and rotate to achieve a desired fit and performance of the face shield lens, such as by achieving a desired rake or lens tilt. Accordingly, the face shield can be dynamically optimized while worn. Rake or lens tilt can be desirable for aesthetic reasons and/or to protect the eyes from environmental debris and harsh conditions. "Rake" can describe the condition of a lens in an as-worn position when the normal line of sight strikes a vertical tangent to the lens or lenses at a non-perpendicular angle.

The face shield lens can have optical qualities related to clarity, resolution, refraction, and field of vision. Higher optical qualities can be achieved when the wearer's straight ahead normal line of sight (LOS) extending from a center of the wearer's eye extends parallel to (or with deviations no more than approximately six degrees and no more than approximately three or four degrees) the optical center line (OCL) of the lens. In some aspects, the vertical tangent extends through the face shield lens. In some aspects, the wearer's straight ahead normal LOS intersects an anterior surface and a posterior surface of the face shield lens at an angle of approximately 90 degrees. Accordingly, the wearer's LOS can be substantially normal to the anterior surface and posterior surface of the face shield lens. In some aspects, the wearer's straight ahead normal LOS intersects an anterior surface and a posterior surface of the face shield lens at a non-perpendicular angle such that the face shield lens comprises a rake or lens tilt. In some aspects, a the wearer's straight ahead normal LOS extending from a center of the wearer's eye passes through a center of the lens with and without a rake or lens tilt.

The helmet can support the face shield in an engaged position and a stowed position. In the engaged position, the face shield can be worn and functional in front of the eyes of the wearer. In the stowed position, the face shield can be stored on the helmet when not in use, but maintained with the helmet to prevent loss of the face shield, for example. The helmet can include an attachment interface, e.g., a magnetic interface, at a front of its shell to support the face shield in the engaged position. Similarly, the helmet can include an attachment interface, e.g., a magnetic interface, at a top of its shell to support the face shield in the stowed position. The face shield can include an attachment interface to attach to the helmet in the engaged position or the stowed position. A release can be included on the face shield to easily remove the face shield from the helmet. As with the adjustment system, a release can be located on one or both ends of the face shield to quickly and easily detach the face shield from the helmet. Actuating one release can release both ends such that one hand can be required for detaching the face shield from the helmet.

Based on the foregoing, the helmet and face shield described herein can provide comfort and fit to the wearer by adjusting the position of the face shield relative to the eyes of the wearer and/or the helmet in an as-worn position. Additionally, a desired lens performance can be achieved by allowing for translation and/or rotation of the face shield relative to the eyes of the wearer. In this way, wearers can quickly and easily select and set desired face shield positioning. These and other aspects will be described with reference to the figures.

As shown in FIG. 1, a helmet-shield adjustment system 1 can include a helmet 100, an adjustment system 200, and a face shield 300. Helmet 100 can protect a wearer's head from injury, such as from impact, as well as from environmental debris and harsh conditions. Face shield 300 can similarly protect the wearer's eyes. In some aspects, the wearer can be a participant in an athletic sport, such as a snow sport. As a skier or a snowboarder, the wearer can experience harsh conditions from wind and light. Additionally, environmental debris such as snow and ice can impact the wearer. To minimize the impact of these factors and prevent debris from contacting the wearer's eyes, helmet 100 and face shield 300 can deflect debris, allowing the wearer to perform uninhibited and maintain visual awareness of their surroundings. Adjustment system 200 can adjust the position of face shield 300 relative to the wearer's eyes and/or helmet 100. In this way, the wearer can optimize the performance of helmet 100 and face shield 300.

Helmet 100 can include an upper shell 110, a lower shell 120, a chinstrap 130, and an earcard 140. In some aspects, upper shell 110 can include EPS (expanded polystyrene). In some aspects, lower shell 120 can be a hard shell. Helmet 100 and face shield 300 can be attached such that they are in an engaged position 20.

Figure 2A:
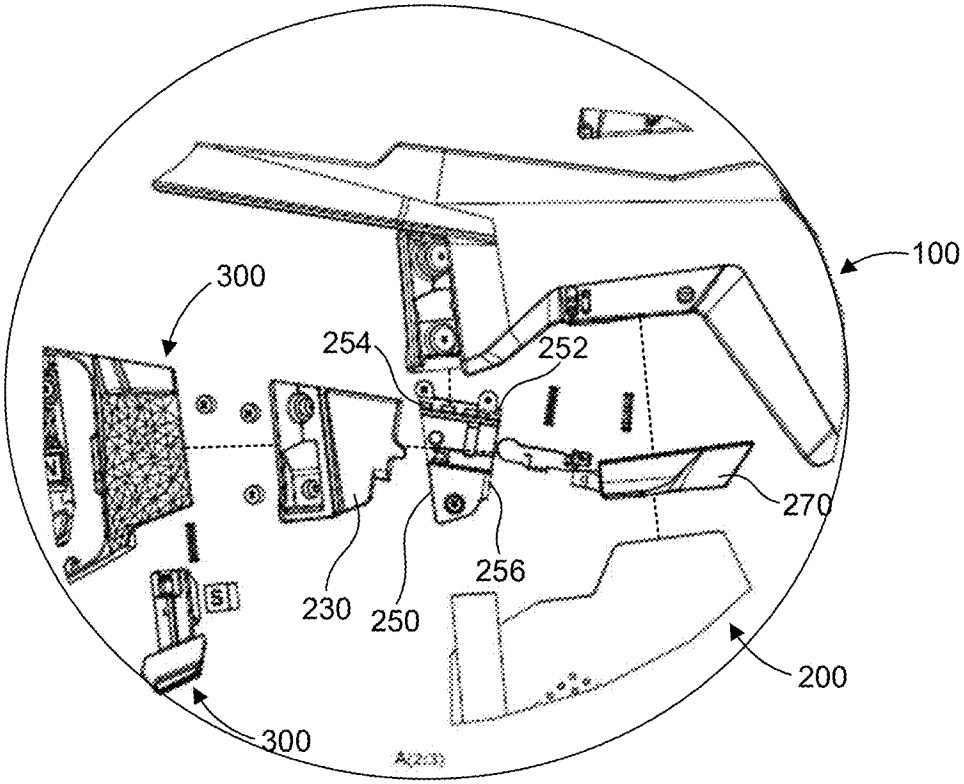
FIG. 2A is a detail view of portion A of the adjustment system of FIG. 2.
Figure 2:
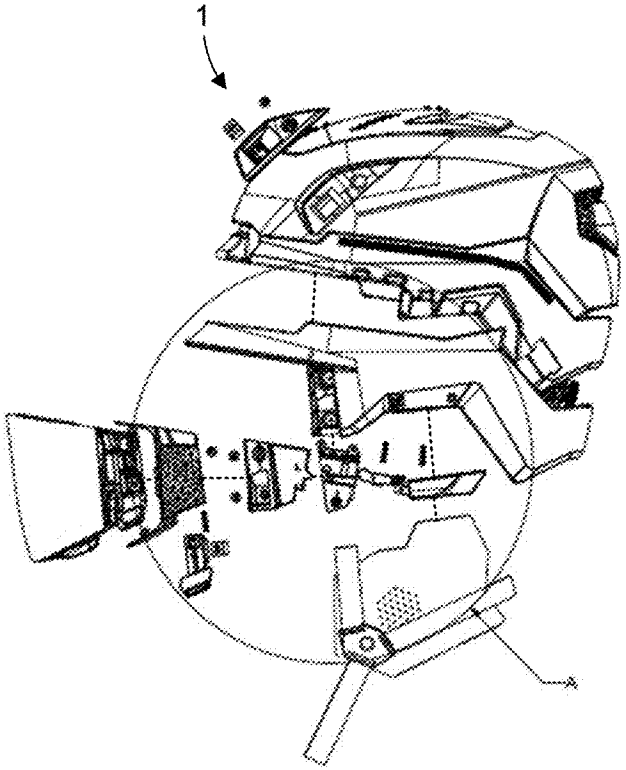
FIG. 2 shows an assembly view of the adjustment system of FIG. 1.

With reference to FIGS. 1-2A, adjustment system 200 can include a slider 230, or a pawl. Adjustment system 200 can also include a frame 250 and a release 270. In some aspects, adjustment system 200 or components thereof can be attached to face shield 300. In some aspects, adjustment system 200 or components thereof can be releasably attached to face shield 300. Similarly, in some aspects, adjustment system 200 or components thereof can be attached to helmet 100. In some aspects, adjustment system 200 or components thereof can be releasably attached to helmet 100. In some aspects, adjustment system 200 or components thereof can be attached to face shield 300 and helmet 100. In some aspects, adjustment system 200 or components thereof can be releasably attached to face shield 300 and helmet 100. In some aspects, face shield 300 can include adjustment system 200. In some aspects, helmet 100 can include adjustment system 200 and face shield 300. As described herein, face shield 300 can be adjusted with adjustment system 200 relative to the eyes of the wearer and/or helmet 100.

In some aspects, frame 250 can be attached to helmet 100. In some aspects, frame 250 can be attached to upper shell 110. In some aspects, frame 250 can be attached to lower shell 120. In some aspects, slider 230 can be attached to face shield 300. In some aspects, frame 250 can include a channel having an upper channel 252 and/or a lower channel 256. Slider 230 can move within upper channel 252 and/or lower channel 256 while helmet-shield adjustment system 1 is in an as-worn position.

As will be described further below, slider 230 can move between secured positions in which face shield 300 can be fixed in position relative to the eyes of the wearer and/or helmet 100. Face shield 300 can be fixed in a first secured position in which face shield 300 can be located at a first distance from an eye of the wearer in an as-worn position and a second secured position in which face shield 300 can be located at a second distance from the eye of the wearer in an as-worn position, where the first distance is less than the second distance (D1 and D1' respectively in FIGS. 3-4). In an aspect, a first secured position can coincide with a posterior positioning such that face shield 300 can be closer to the eyes of the wearer and/or helmet 100. In an aspect, a second secured positioning can coincide with an anterior positioning such that face shield 300 can be farther from the eyes of the wearer and/or helmet 100 relative to a first secured position. In this way, slider 230 can move within upper channel 252 and/or lower channel 256 to adjust face shield 300 relative to the eyes of the wearer and/or helmet 100 while face shield 300 and helmet 100 are worn.

Figure 3:
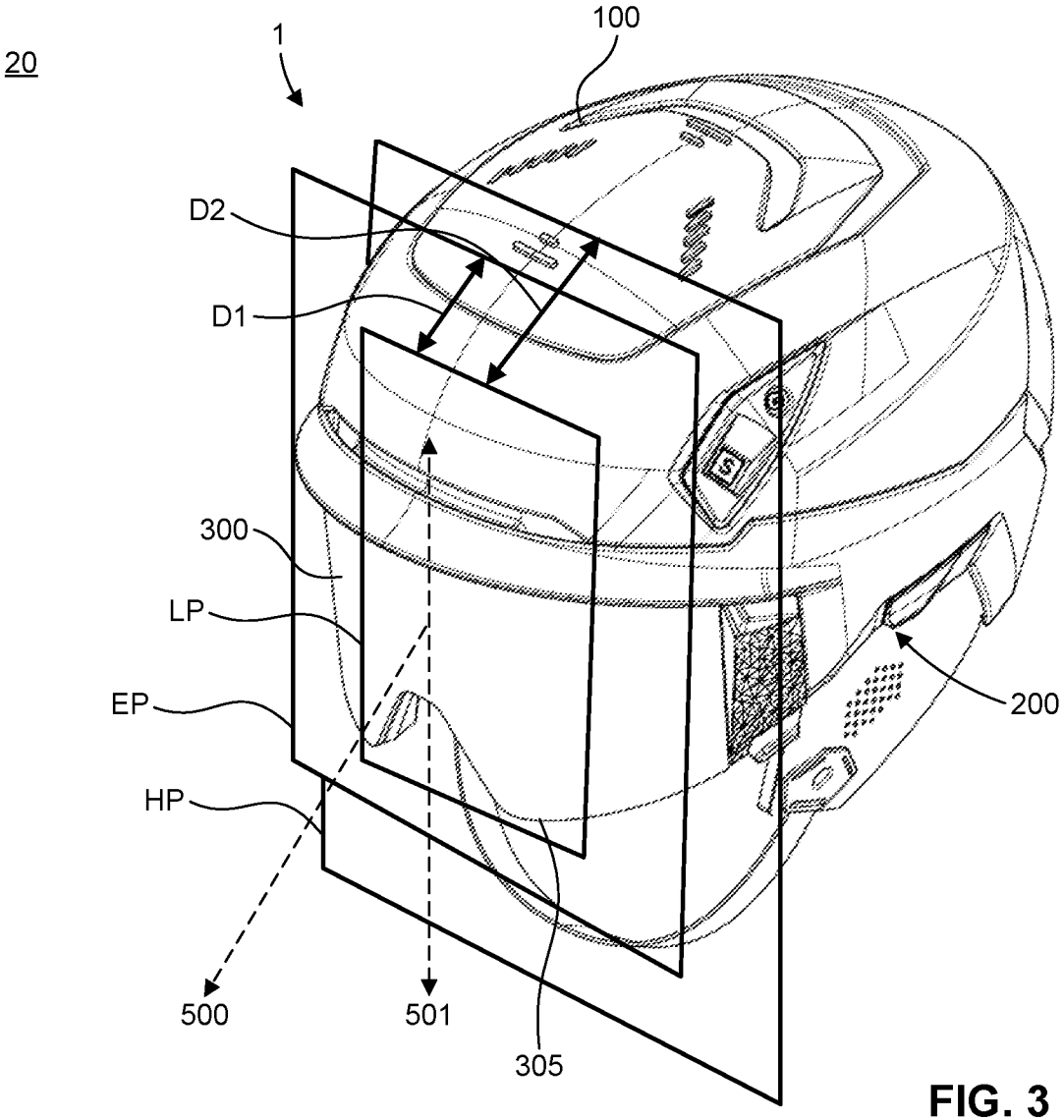
FIG. 3 shows a perspective view of the helmet-shield adjustment system of FIG. 1.

FIG. 3 shows helmet-shield adjustment system 1 in engaged position 20. As shown, helmet 100 and face shield 300 can be worn such that engaged position 20 coincides with an as-worn positon. A helmet plane HP can be aligned with a surface of helmet 100, e.g., a front surface. An eye plane EP can lie on a surface of the eyes of the wearer and can be parallel to a coronal plane. A lens plane LP can be aligned with a surface of face shield 300, e.g., a front surface. An anterior-posterior (AP) line 500 can extend between a posterior side to an anterior side of the wearer. This AP line 500 can extend within a sagittal plane. A tangent line 501 can extend through face shield 300.

As shown, D1 can be the distance between lens plane LP and eye plane EP. In some aspects, D1 can represent the distance between face shield 300 and the eyes of the wearer. D2 can be the distance between lens plane LP and eye plane EP. In some aspects, D2 can represent the distance between face shield 300 and helmet 100.

Figure 4:
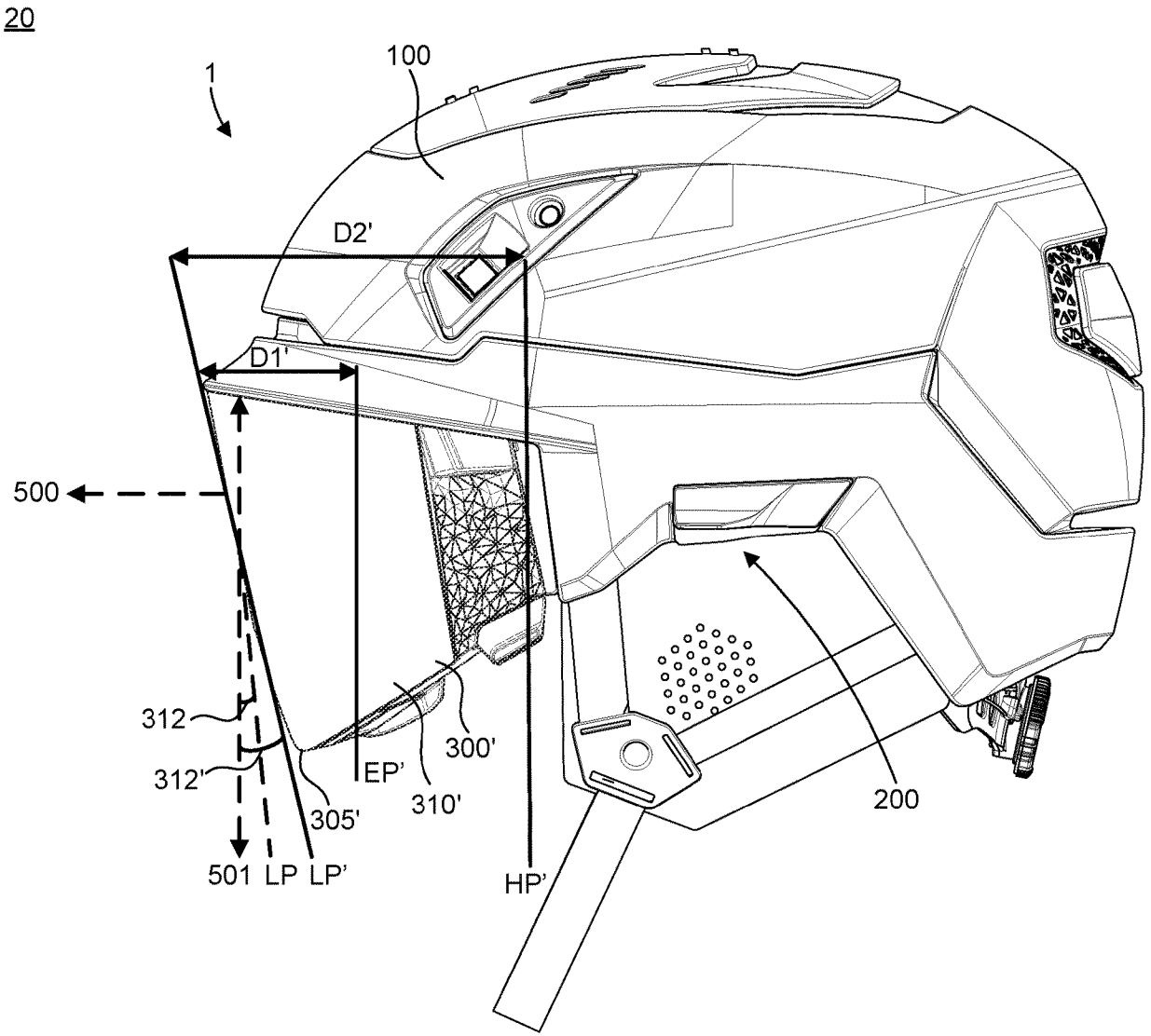
FIG. 4 shows a side view of the helmet-shield adjustment system of FIG. 1.

FIG. 4 shows helmet-shield adjustment system 1 in engaged position 20. As shown, face shield 300 (FIG. 3) can be adjusted in an as-worn position from the position of FIG. 3 using adjustment system 200 to a second secured position. A second secured position can coincide with an anterior positioning in which face shield 300 can be farther from the eyes of the wearer and/or helmet 100 relative to a first secured position with a posterior positioning in which face shield 300 can be closer to the eyes of the wearer and/or helmet 100 (FIG. 3). In some aspects, the adjustment can include translation and/or rotation. The adjustment to a second secured position from a first secured position of FIG. 3 can be shown in FIG. 4 by helmet plane HP', eye plane EP', lens plane LP', face shield 300', D1', and D2'. In some aspects, the adjustment can be from the position of FIG. 4 to the position of FIG. 3.

Figure 5:
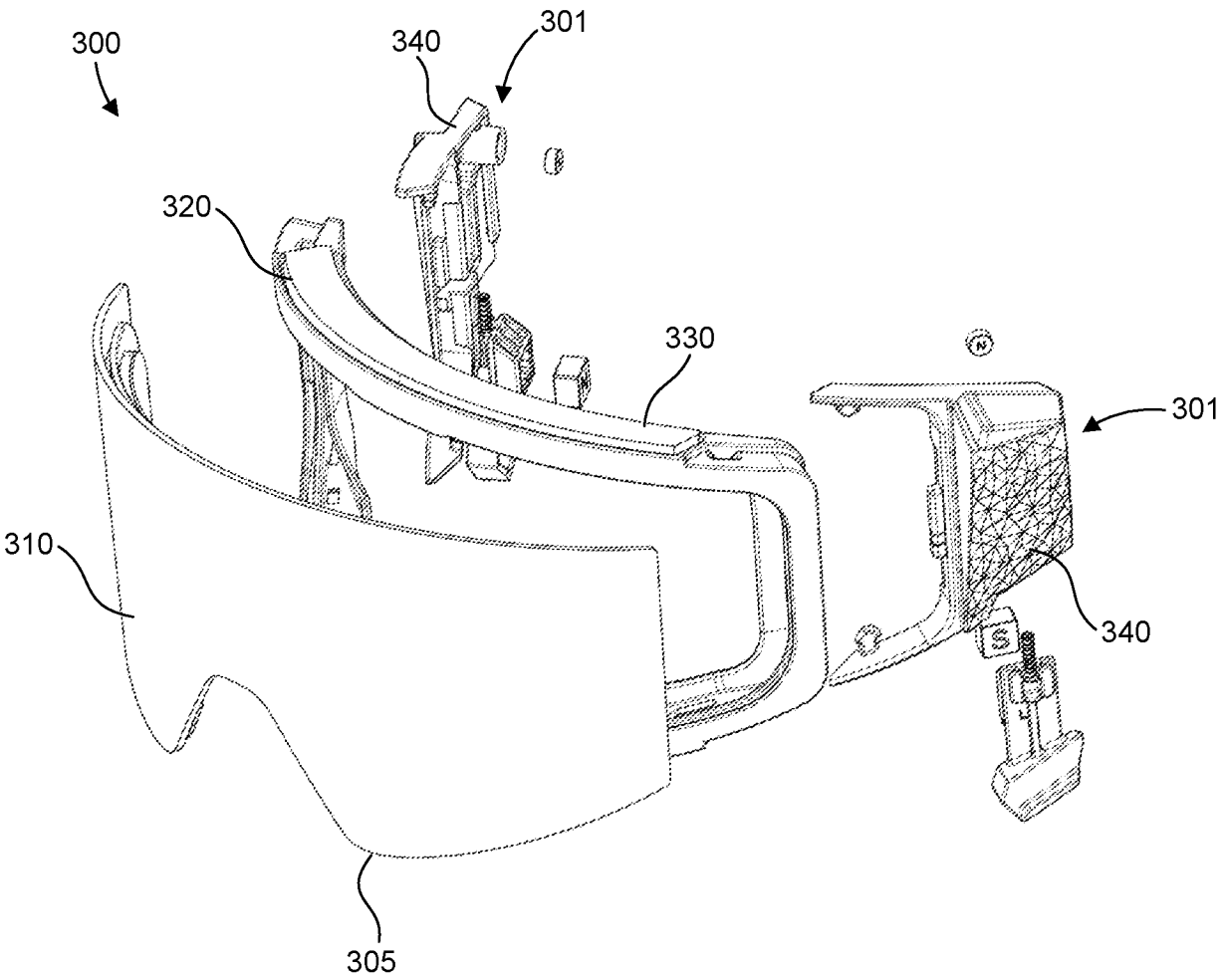
FIG. 5 shows an assembly view of the face shield of FIG. 1.

As shown in FIG. 5, face shield 300 can include a face shield lens 310 and frame 320. In an aspect, frame 320 can be a TPU (thermoplastic polyurethane) frame. Frame 320 can be attached to face shield lens 310. In an aspect, frame 320 can be integral with face shield lens 310. Frame 320 can also be attached to slider 230 of adjustment system 200 (FIG. 2A). In some aspects, frame 320 can be attached to slider 230 via an outrigger 340. For example, frame 320 can be attached to slider 230 via an outrigger 340 on either end 301 of face shield 300. In an aspect, frame 320 and slider 230 can be integral. Accordingly, slider 230 can move within upper channel 252 and/or lower channel 256 to adjust the position of face shield lens 310 relative to the eyes of the wearer and/or helmet 100 in an as-worn position. In some aspects, face shield 300 can include a foam face 330 that can form a seal with the wearer's face as face shield 300 changes position relative to the eyes of the wearer and/or helmet 100 in an as-worn position.

With reference to FIGS. 3-5, in some aspects, a wearer's LOS extends from a center of the wearer's eyes. In some aspects, the wearer's straight ahead normal LOS intersects an anterior surface and a posterior surface of face shield lens 310 at an angle of approximately 90 degrees. Accordingly, the wearer's LOS can be substantially normal to the anterior surface and posterior surface of face shield lens 310. In some aspects, a wearer's LOS is parallel to AP line 500 when the wearer's head is in an upright vertical position. In some aspects, the wearer's straight ahead normal LOS intersects an anterior surface and a posterior surface of face shield lens 310 at a non-perpendicular angle such that face shield lens 310 comprises a rake or lens tilt. In some aspects, a the wearer's straight ahead normal LOS extending from a center of the wearer's eye passes through a center of face shield lens 310 with and without a rake or lens tilt.

In some aspects, tangent line 501 can extend through face shield lens 310. In some aspects, tangent line 501 can be parallel with a coronal plane. In some aspects, tangent line 501 can be perpendicular to AP line 500. In some aspects, lens plane LP, which can be aligned with face shield lens 310, can be oriented to be parallel to tangent line 501. In this orientation, face shield lens 310 can be oriented with minimal rake or lens tilt. In some aspects, lens plane LP can be parallel to tangent line 501 in a first secured position. In some aspects, in a second secured position, lens plane LP' can be oriented to be parallel to tangent line 501 such that face shield lens 310 has minimal rake or lens tilt.

In some aspects, face shield 300 and/or face shield 300' and components thereof can be oriented to have a rake or lens tilt. In some aspects, as shown in FIG. 4, lens plane LP in a first secured position (FIG. 3) can be oriented at an angle relative to tangent line 501. In some aspects, the angle can provide a rake or lens tilt 312. In some aspects, lens tilt 312 can be between one degree and five degrees. In some aspects, lens plane LP' in a second secured position can be oriented at an angle relative to tangent line 501. In some aspects, the angle can provide a rake or lens tilt 312'. In some aspects, face shield lens 310' in a second secured position can be maintained at the same angle from tangent line 501 as lens tilt 312. In some aspects, lens tilt 312' can be between one degree and 15 degrees, such as between five degrees and 10 degrees, such as seven degrees. In some aspects, adjustment system 200 can provide rotational adjustment between a first secured position and a second secured position. In some aspects, the rake adjustment between lens tilt 312 in a first secured position and lens tilt 312' in a second secured position can be between one degree and five degrees. In some aspects, face shield lens 310 can be curved. In some aspects, lens tilt 312 or lens tilt 312' can vary across face shield lens 310 (e.g., across an upper edge to a lower edge of face shield lens 310).

In some aspects, adjustment between a first secured position with a posterior positioning and a second secured position with an anterior positioning (FIGS. 3-4) can be along a plane parallel to AP line 500. In some aspects, adjustment along a plane parallel to AP line 500 can be generally equal across face shield lens 310 (e.g., across an upper edge to a lower edge of face shield lens 310). In some aspects, adjustment along a plane parallel to AP line 500 can provide minimal shift in an inferior-superior direction (e.g., a direction parallel to tangent line 501). In some aspects, the shift in the inferior-superior direction can be less than approximately four millimeters, such as less than approximately three millimeters, such as less than approximately two millimeters. In some aspects, adjustment along a plane parallel to AP line 500 can provide minimal rake adjustment. In some aspects, the rake adjustment can be less than four degrees, such as less than three degrees, such as less than two degrees. In some aspects, the shift in the inferior-superior direction and/or a rake adjustment during adjustment along a plane parallel to AP line 500 can be minimized to maintain the wearer's LOS in the center of face shield lens 310.

In some aspects, adjustment between a first secured position with a posterior positioning and a second secured position with an anterior positioning can be along a plane parallel to AP line 500, in an inferior-superior direction, and/or with rake adjustment. In some aspects, this adjustment can maintain the wearer's LOS in the center of face shield lens 310. Accordingly, the wearer's LOS can be in the center of face shield lens 310 in both a first secured position with a posterior positioning and a second secured position with an anterior positioning.

In some aspects, the adjustment between a first secured position with a posterior positioning and a second secured position with an anterior positioning (FIGS. 3-4) along a plane parallel to AP line 500 can be represented by the difference between D1 and D1'. D1 can be at a first secured position with a posterior positioning in which face shield 300 can be closer to the eyes of the wearer relative to a second secured position with an anterior positioning, and D1' can be at a second secured position with an anterior positioning in which face shield 300' can be farther from the eyes of the wearer relative to a first secured position with a posterior positioning. In some aspects, the difference between D1 and D1' can be between approximately five millimeters and approximately 30 millimeters, such as between approximately seven millimeters and approximately 25 millimeters, such as between approximately nine millimeters and approximately 20 millimeters, such as approximately 10 millimeters. In some aspects, the adjustment between a first secured position with a posterior positioning and a second secured position with an anterior positioning along a plane parallel to AP line 500 can be represented by the difference between D2 and D2'. D2 can be at a first secured position with a posterior positioning in which face shield 300 can be closer to helmet 100 relative to a second secured position with an anterior positioning, and D2' can be at a second secured position with an anterior positioning in which face shield 300' can be farther from helmet 100 relative to a first secured position with a posterior positioning. In some aspects, the difference between D2 and D2' can be between approximately five millimeters and approximately 30 millimeters, such as between approximately seven millimeters and approximately 25 millimeters, such as between approximately nine millimeters and approximately 20 millimeters, such as approximately 10 millimeters.

As shown, face shield 300 (FIG. 3) can include a lower edge 305 (FIG. 3). In some aspects, the adjustment from a first secured position with a posterior positioning to a second secured position with an anterior positioning can be can be illustrated with reference to lower edge 305 and lower edge 305' in FIG. 3 and FIG. 4, respectively. Similarly, the adjustment from a second secured position with an anterior positioning to a first secured position with a posterior positioning can be can be illustrated with reference to lower edge 305' and lower edge 305 in FIG. 4 and FIG. 3, respectively. In some aspects, face shield 300' can be oriented such that the lower edge 305' can be angled towards the wearer (e.g., pantoscopic tilt). In some aspects, face shield 300' can be oriented such that the lower edge 305' is angled away from the wearer (e.g., retroscopic tilt).

With reference to FIGS. 1-2 and 5, in some aspects, helmet-shield adjustment system 1 can include an adjustment system 200 on either side 101 (FIG. 1) of helmet-shield adjustment system 1. In some aspects, ends 301 (FIG. 5) of face shield 300 can be adjusted independently using adjustment system 200 on the respective side 101. In some aspects, ends 301 of face shield 300 can be adjusted simultaneously (e.g., together) using adjustment system 200 on either side 101. In some aspects, adjustment of ends 301 between a first secured position with a posterior positioning and a second secured position with an anterior positioning can be the same along a plane parallel to AP line 500, in an inferior-superior direction, and/or with rake adjustment. In some aspects, a frame 250 can be attached to helmet 100 on each side 101 as part of each adjustment system 200. In some aspects, first and second frames 250 on either side 101 can be the same. For example, a second frame 250 can include a second channel having upper channel 252 and/or lower channel 256. Accordingly, slider 230 can move within upper channel 252 and/or lower channel 256 of the first frame 250. Similarly, a second slider 230 can move within upper channel 252 and/or lower channel 256 of the second frame 250. In this way, slider 230 can move with second slider 230 between a first secured position and a second secured position. Ends 301 of face shield 300 can thus move simultaneously based on the attachment between first and second sliders 230 and face shield 300 (e.g., via outriggers 340 on ends 301).

Adjustment system 200 can be shown in FIGS. 6-11, with which helmet-shield adjustment system 1 can be adjusted between a first secured position with a posterior positioning and a second secured position with an anterior positioning along a plane parallel to AP line 500, (e.g., a direction parallel to tangent line 501), and/or with a rake adjustment.

Figure 6:
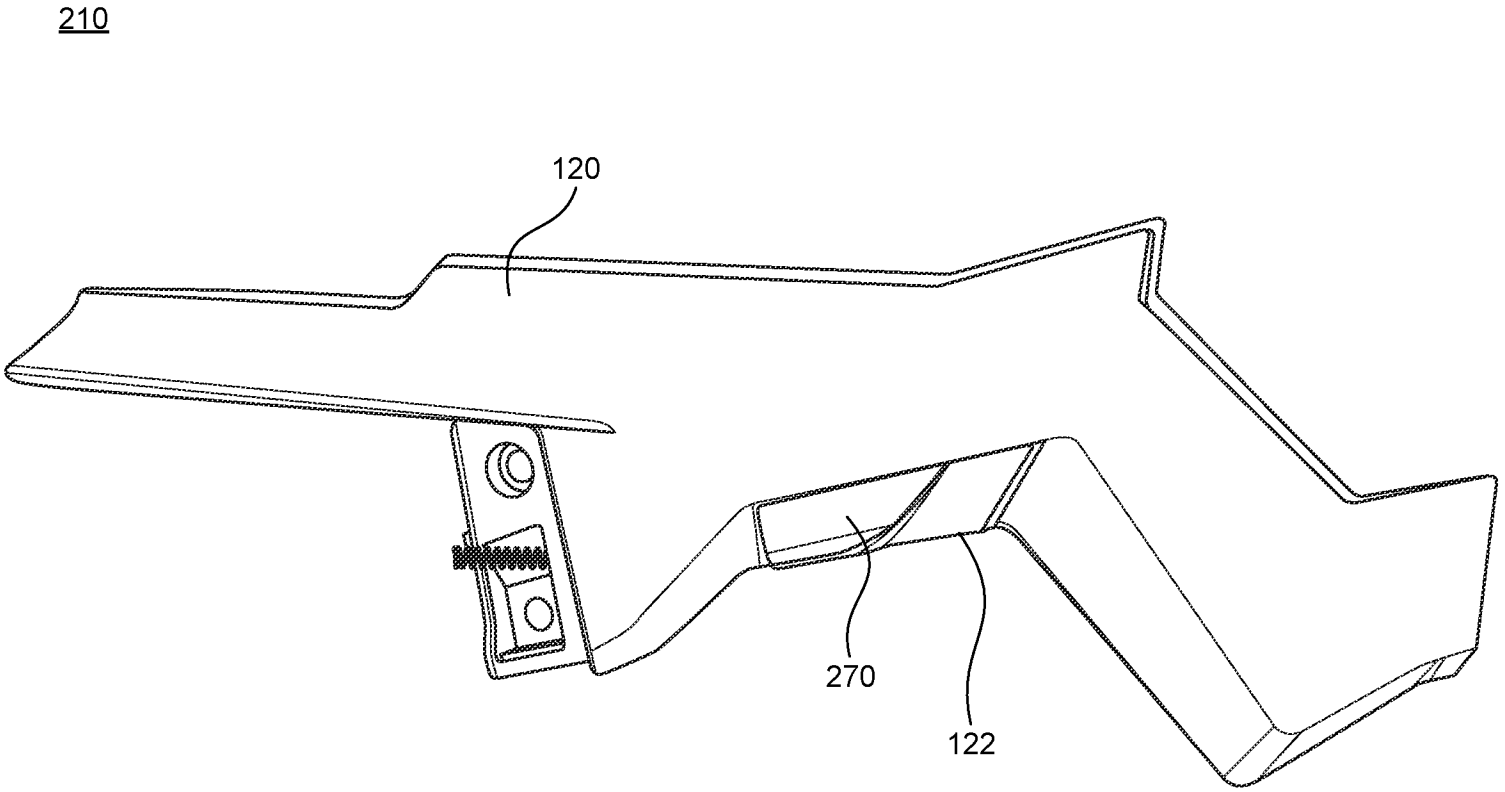
FIG. 6 shows a side view of the adjustment system of FIG. 1.

FIG. 6 shows a view from the exterior of helmet-shield adjustment system 1. As shown, in some aspects, lower shell 120 of helmet 100 can be attached to release 270 of adjustment system 200. In some aspects, release 270 can be attached to upper shell 110 of helmet 100 (FIG. 1). In some aspects, release 270 can be a button or a lever accessible to the wearer from the exterior of helmet-shield adjustment system 1. Adjustment system 200 and its components can have a rest position 210. In rest position 210, slider 230 (FIG. 2A) can be in a secured position. In some aspects, release 270 can be coplanar with helmet 100 in rest position 210. In some aspects, release 270 can be coplanar with a bottom edge 122 of lower shell 120 in rest position 210, as shown.

Figure 7:
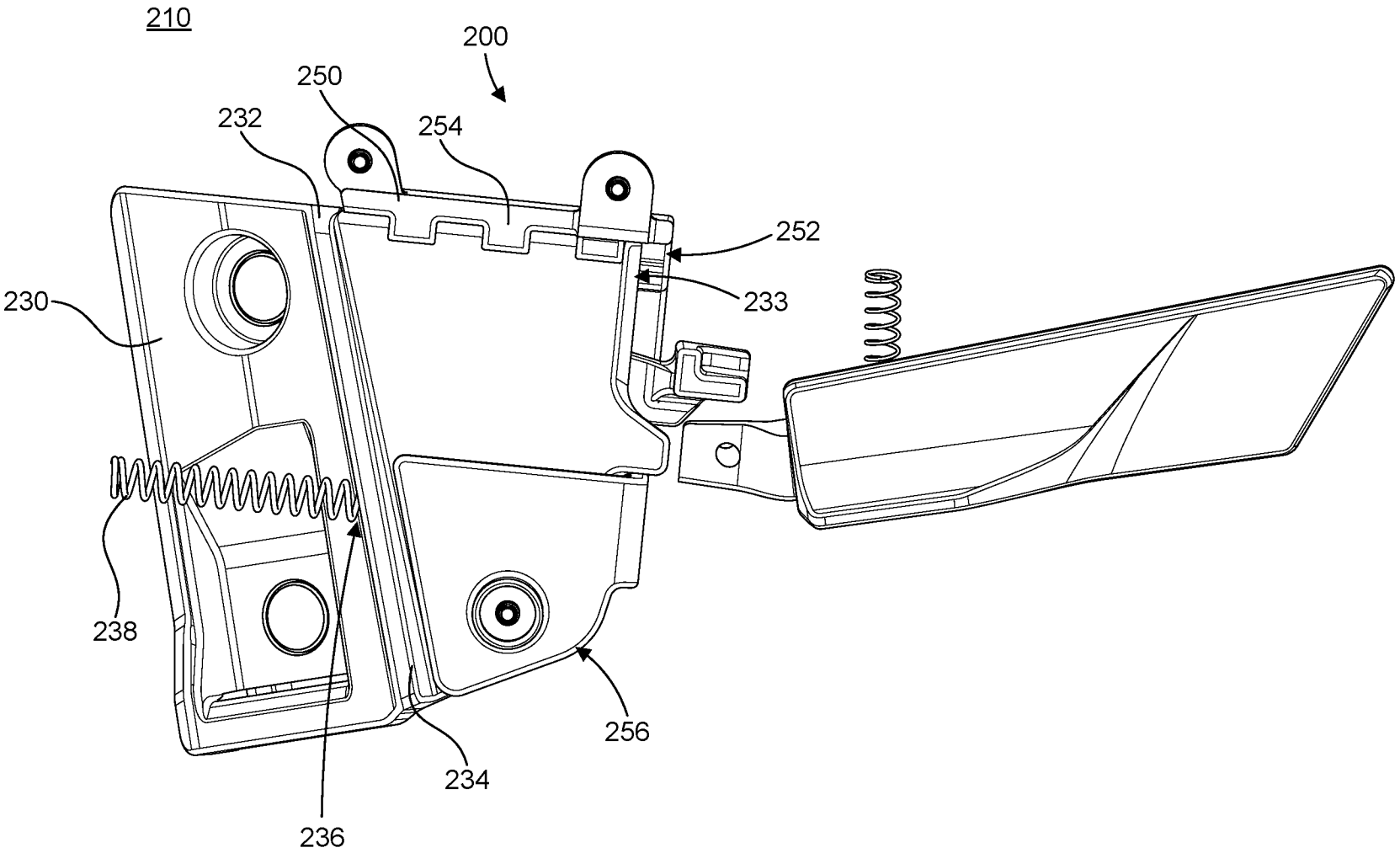
FIG. 7 shows a side view of the adjustment system of FIG. 1.

FIG. 7 shows a view from the exterior of helmet-shield adjustment system 1 with lower shell 120 of helmet 100 removed. As shown, slider 230 can include an upper end 232 and a lower end 234. Upper end 232 can fit within upper channel 252 of frame 250. Lower end 234 can fit within lower channel 256 of frame 250. In some aspects, upper channel 252 can be bounded by a track 254 of frame 250. Track 254 can contain upper end 232 of slider 230 within upper channel 252 such that upper end 232 moves within upper channel 252. In some aspects, slider 230 can include a protrusion 233 (FIG. 9) that can move within the channel (e.g., upper channel 252 and/or lower channel 256) of frame 250. In some aspects, track 254 can contain protrusion 233 such that protrusion 233 moves within upper channel 252 and/or lower channel 256 of frame 250.

In some aspects, upper channel 252 and/or lower channel 256 can extend linearly through frame 250. In some aspects, upper channel 252 and/or lower channel 256 can curve through frame 250. In some aspects, upper channel 252 and/or lower channel 256 can both extend linearly and curve through frame 250. In some aspects, slider 230 can move linearly and/or non-linearly within upper channel 252 and/or lower channel 256 while helmet-shield adjustment system 1 is in an as-worn position. in some aspects, slider 230 can rotate within frame 250 while helmet-shield adjustment system 1 is in an as-worn position.

In some aspects, slider 230 can also include a spring aperture 236 and a spring 238. Spring aperture 236 can receive spring 238. Spring 238 can be supported between spring aperture 236 and frame 250. In an aspect, spring 238 can bias slider 230. For example, slider 230 can be biased to extend further into upper channel 252 and/or lower channel 256 of frame 250 via the extension of spring 238. Accordingly, slider 230 can be biased to extend further into frame 250 such that face shield 300 attached thereto (FIGS. 1-2A, and 5) can be similarly biased. Slider 230 in an inward position can position face shield 300 closer to the eyes of the wearer and/or helmet 100 (e.g., D1 and D2 in FIG. 3 relative to D1' and D2', respectively, in FIG. 4). As will be described further below, slider 230 can move between a first secured position with a posterior positioning and a second secured position with an anterior positioning (FIGS. 3-4). In an aspect, a first secured position with a posterior positioning can coincide with the biased position of slider 230 where slider 230 can extend further into frame 250. Accordingly, slider 230 can be biased to a first secured position with a posterior positioning.

Figure 8:
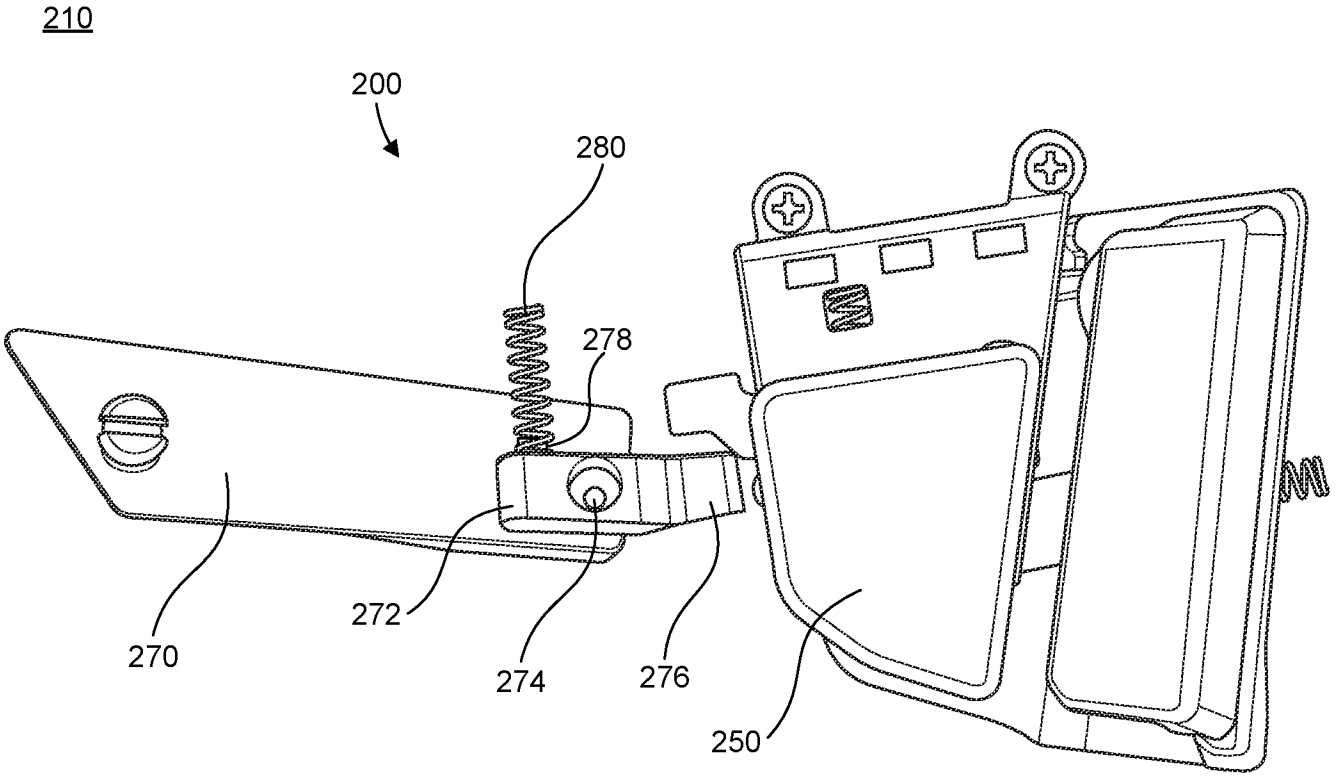
FIG. 8 shows a side view of the adjustment system of FIG. 1.

FIG. 8 shows a view from the interior of helmet-shield adjustment system 1 with lower shell 120 of helmet 100 removed. As shown, in some aspects, helmet 100 (FIG. 1) can include a pad 150. Pad 150 can separate adjustment system 200 from helmet 100. In some aspects, pad 150 can provide comfort to the wearer.

In some aspects, release 270 can include an anchor 272 having a pinned portion 274 and a free end 276. In some aspects, pinned portion 274 can be attached to release 270. In an aspect, anchor 272 can be pivotally attached to release 270 at pinned portion 274 such that anchor 272 can rotate about pinned portion 274 relative to release 270. In some aspects, anchor 272 can be fixed to release 270. In some aspects, anchor 272 can also include an anchor spring protrusion 278 and a spring 280. In some aspects, protrusion 278 can extend upward from anchor 272 to support spring 280 between anchor 272 and lower shell 120 (FIG. 5). Accordingly, release 270 can be attached to spring 280 via anchor 272. This attachment can bias release 270 via the extension of spring 280. For example, release 270 can be biased such that adjustment system 200 and its components are in rest position 210. As discussed above with reference to FIG. 6, in rest position 210, release 270 can be coplanar with bottom edge 122 of lower shell 120. Thus, release 270 can be biased to be coplanar with bottom edge 122 of lower shell 120 in rest position 210. In rest position 210, slider 230 can be in a secured position (e.g., a first secured position shown in FIG. 3 or a second secured position shown in FIG. 4).

Figure 9:
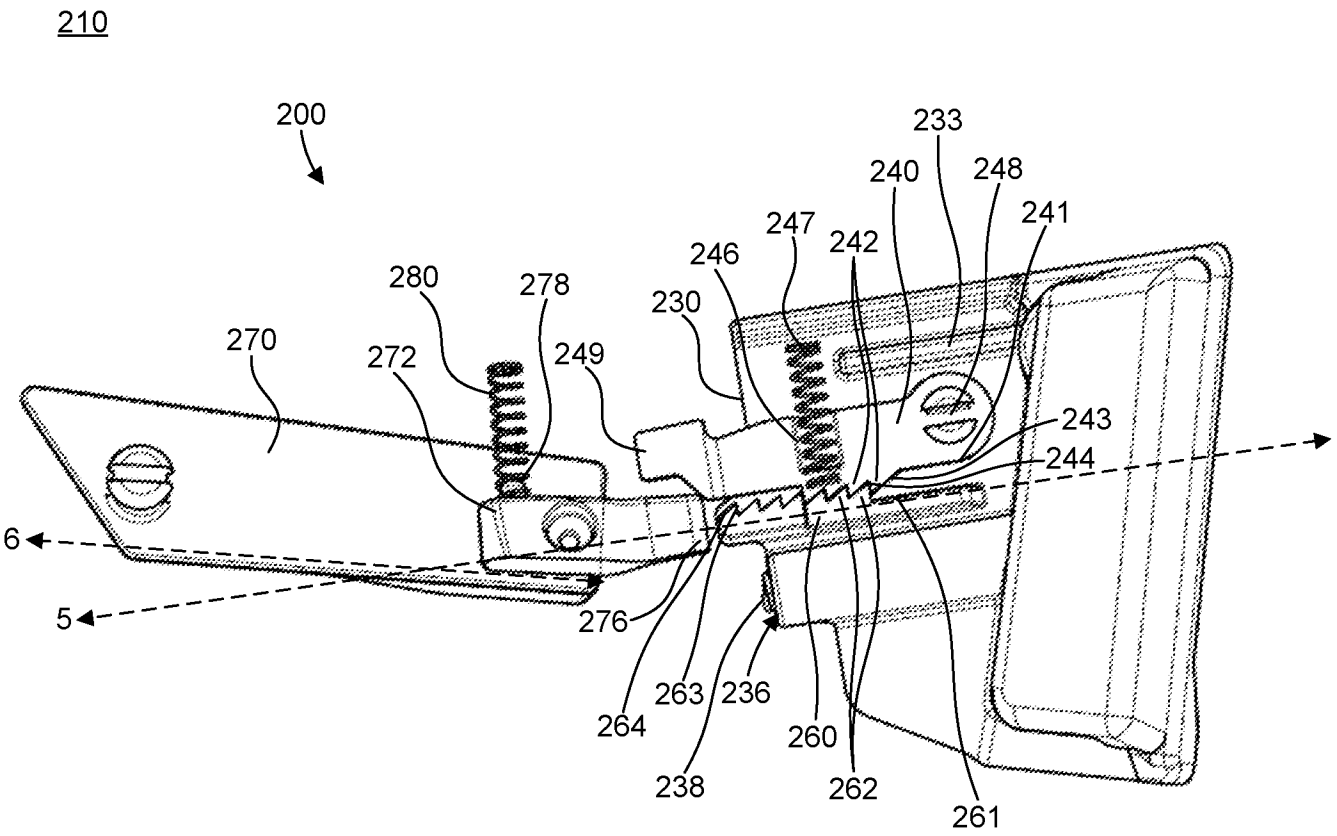
FIG. 9 shows a side view of the adjustment system of FIG. 1.

FIG. 9 shows a view from the interior of helmet-shield adjustment system 1 with lower shell 120 and pad 150 of helmet 100 removed. Additionally, frame 250 is removed. As shown, in some aspects, slider 230 can include a slider member 240. In some aspects, slider member 240 can have a pinned end 248 and a free end 249. In some aspects, slider member 240 can have one or more slider teeth 242. In an aspect, slider teeth 242 can be positioned along a bottom edge 241 of slider member 240. Accordingly, slider teeth 242 can be part of slider member 240. In some aspects, slider teeth 242 can be integral with slider 230. In some aspects, slider member 240 can include a spring aperture 246. In some aspects, slider member 240 can include a spring 247. In an aspect, spring aperture 246 can receive spring 247. Spring 247 can be supported between spring aperture 246 and frame 250. In some aspects, frame 250 can include a frame member 260. In some aspects, frame member 260 can be fixed on frame 250. In some aspects, frame member 260 can have one or more frame teeth 262. In an aspect, frame teeth 262 can be positioned along top edge 261 of frame member 260. In some aspects, frame teeth 262 can be integral with frame 250.

In some aspects, slider member 240 can include spring 247 to bias slider member 240. Slider member 240 can be biased such that slider member 240 can be engaged with frame member 260 via the extension of spring 238, as shown. Accordingly, slider member 240 can be biased to engage frame member 260. Frame member 260 can be attached to frame 250 (FIG. 8) to hold slider 230 in a first secured position with a posterior positioning and a second secured position with an anterior positioning (FIGS. 3-4).

In some aspects, slider member 240 of slider 230 and frame member 260 of frame 250 can engage via slider teeth 242 and frame teeth 262. The engagement between slider teeth 242 and frame teeth 262 can inhibit translation and/or rotation of slider 230 such that slider 230 can be secured in place. In some aspects, frame member 260 attached to frame 250 (FIG. 8) can engage slider 230 in a first secured position with a posterior positioning and a second secured position with an anterior positioning (FIGS. 3-4). In other words, frame teeth 262 can selectively engage slider teeth 242 of slider 230 in a first secured position and a second secured position based on the wearer's desired positioning. In a first secured position, face shield 300 (FIGS. 1-2 and 5), which can be attached to slider 230, can be fixed in position relative to the eyes of the wearer and/or helmet 100 (e.g., D1 and D2 in FIG. 3 are constant). Accordingly, face shield lens 310 (FIG. 5) of face shield 300 can be fixed in position relative to the eyes of the wearer and/or helmet 100. Similarly, in a second secured position, face shield 300' can be fixed in position relative to the eyes of the wearer and/or helmet 100 (e.g., D1' and D2' in FIG. 4 are constant).

In some aspects, slider 230 and/or frame 250 (FIG. 8) can include a lock (e.g., a latch) to hold slider member 240 in engagement with frame member 260 to prevent spring 247 from compressing and releasing slider teeth 242 of slider member 240 from engagement with frame teeth 262 of frame member 260.

In some aspects, slider member 240 can include between three and ten slider teeth 242. In some aspects, slider member 240 can include four slider teeth 242. Each slider tooth 242 can include a front edge 243 and a rear edge 244. Front edge 243 can be the edge facing pinned end 248 and can be angled relative to a longitudinal axis 5 disposed on a plane coinciding with top edge 261 of frame member 260. Rear edge 244 can be the edge facing free end 249 and can extend perpendicularly relative to longitudinal axis 5. In some aspects, frame member 260 can include between five and fifteen frame teeth 262. In some aspects, frame member 260 can include seven frame teeth 262. Each frame tooth 262 can include a front edge 263 and a rear edge 264. Front edge 263 can be the edge farther from release 270 and can extend perpendicularly relative to longitudinal axis 5. Rear edge 264 can be the edge facing release 270 and can be angled relative to longitudinal axis 5. In some aspects, rear edge 244 and rear edge 264 can extend at the same angle from longitudinal axis 5.

In some aspects, each slider tooth 242 and frame tooth 262 can have the same width at their respective widest portions. In some aspects, each slider tooth 242 and frame tooth 262 can include a width at their widest portion of approximately two millimeters. In some aspects, each slider tooth 242 and frame tooth 262 can include a height at their tallest portion of approximately one millimeter to approximately two millimeters. In some aspects, the engagement between slider teeth 242 and frame teeth 262 can include rear edge 244 of slider teeth 242 and front edge 263 of frame teeth 262 engaging. Similarly, in some aspects, the engagement between slider teeth 242 and frame teeth 262 can include front edge 243 of slider teeth 242 and rear edge 264 of frame teeth 262 engaging.

In some aspects, slider 230 can be attached to a strap that can be fixed to secure slider in place. In some aspects, slider 230 can be attached to a strap that can snap to frame 250 to secure slider 230 in place. In some aspects, one or more snaps can be fixed onto frame 250. In some aspects, one or more snaps can be fixed onto helmet 100. In this way, slider 230 can be attached to a strap that can snap to secure slider 230 in one of a plurality of positions. Accordingly, slider 230 can move between a first secured position with a posterior positioning and a second secured position with an anterior positioning (FIGS. 3-4).

In some aspects, to disengage slider 230 from frame member 260, slider teeth 242 of slider member 240 can disengage from frame teeth 262 of frame member 260. Disengaging slider teeth 242 and frame teeth 262 can allow for translation and/or rotation of slider 230 such that slider 230 is not in a secured position. In this way, slider 230 and face shield 300 attached thereto can be moved relative to the eyes of the wearer and/or helmet 100 while in an as-worn position. Additionally, face shield lens 310 (FIG. 5) of face shield 300 can be moved relative to the eyes of the wearer and/or helmet 100.

As shown in FIG. 9, in some aspects, pinned end 248 of slider member 240 can be attached to slider 230. In some aspects, slider member 240 can be pivotally attached to slider 230 at pinned end 248 such that slider member 240 can rotate about pinned end 248 relative to slider 230. In some aspects, free end 249 can be coupled to release 270. In some aspects, free end 249 can be coupled to free end 276 of release 270. Accordingly, as release 270 moves from its biased position, free end 249 of slider member 240 can be moved by free end 276 of release 270. This movement can compress spring 247 of slider member 240 such that slider member 240 can be moved away from its biased position. In some aspects, moving slider member 240 away from its biased position can disengage slider 230 from frame member 260. The movement of release 270 can move adjustment system 200 and its components to an actuated position 220.

In some aspects, helmet-shield adjustment system 1 can include a release 270 on either side 101 of helmet-shield adjustment system. In some aspects, a single release 270 can be actuated to release adjustment system 200 on either side 101 of helmet-shield adjustment system 1. In some aspects, release 270 on either side 101 of helmet-shield adjustment system 1 can be operatively attached (e.g., by a wire) such that actuation of one release 270 can actuate both releases 270. In this way, adjustment system 200 on either side 101 can be in actuated position 220 by actuating one or more releases 270. Additionally, actuation of one release 270 can require one hand to operate adjustment system 200.

Figure 10:
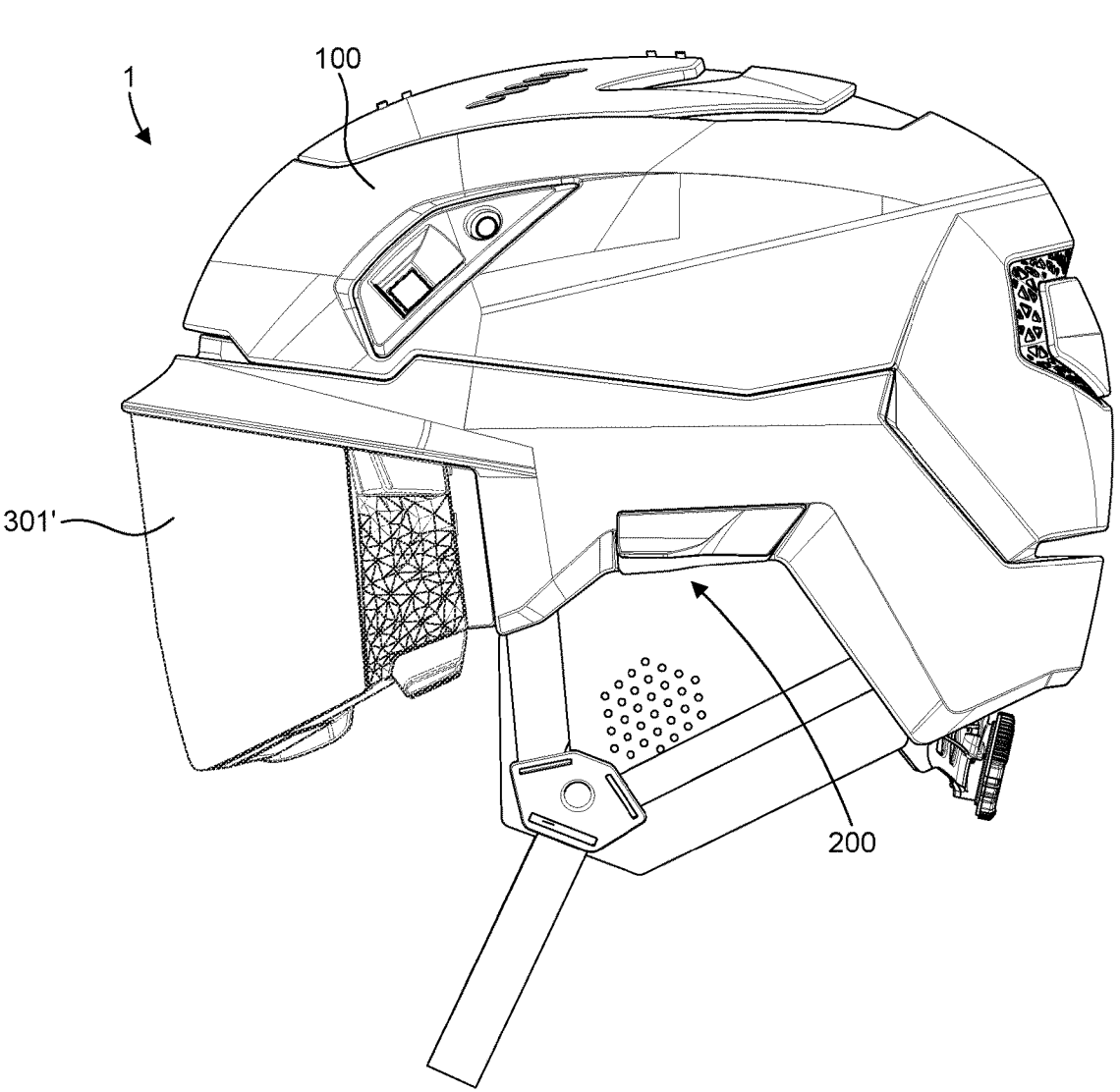
FIG. 10 shows a side view of the helmet-shield adjustment system of FIG. 1.
Figure 11:
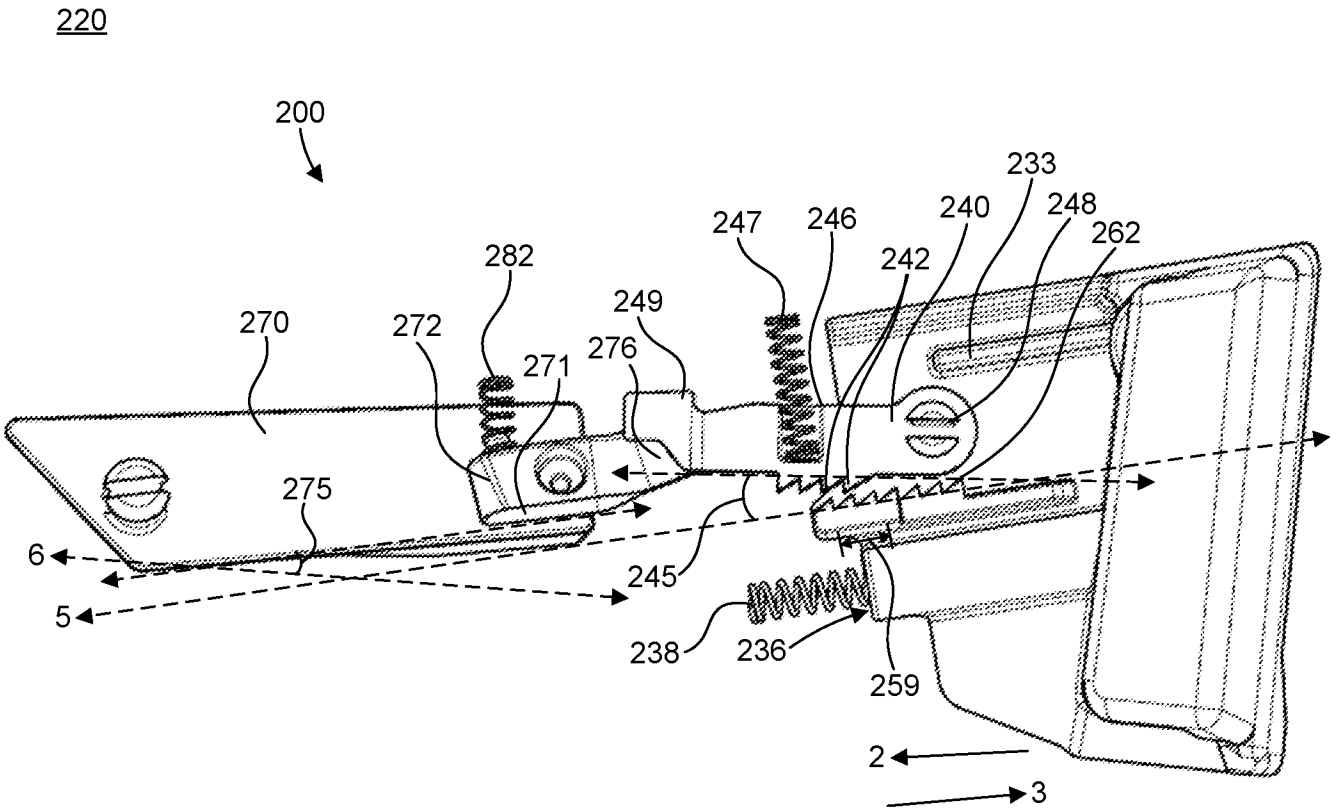
FIG. 11 shows a side view of the adjustment system of FIG. 1.

With reference to FIGS. 10-11, adjustment system 200 and components thereof can be in actuated position 220. FIG. 11 shows a view from the interior of helmet-shield adjustment system 1 with lower shell 120 and pad 150 of helmet 100 removed. Additionally, frame 250 is removed. In actuated position 220, frame member 260 can be disengaged from slider member 240 to move slider 230 in an as-worn position. Thus, adjustment system 200 can be in actuated position 220 while helmet-shield adjustment system 1 is in engaged position 20. Accordingly, slider 230 and face shield 300 attached thereto can be moved while helmet 100 and face shield 300 are attached between a first secured position with a posterior positioning and a second secured position with an anterior positioning (FIGS. 3-4). Once a desired position is reached, the wearer can return adjustment system 200 to rest position 210 such that release 270 is no longer actuated and frame member 260 and slider 230 can engage to fix slider 230 and face shield 300 attached thereto in a secured position relative to the eyes of the wearer and/or helmet 100.

Release 270 moving from rest position 210 to actuated position 220 can thus disengage frame member 260 from slider 230 to move slider 230 in an as-worn position. In other words, release 270 in actuated position 220 can disengage slider 230 to move face shield 300 between a first secured position with a posterior positioning and a second secured position with an anterior positioning (FIGS. 3-4).

In some aspects, a distance 239 along longitudinal axis 5 between a first secured position with a posterior positioning and a second secured position with an anterior positioning can be less than a length of frame member 260. In some aspects, distance 239 can represent the displacement of slider 230. In some aspects, distance 239 can be within a range of approximately one millimeter to approximately 15 millimeters, such as approximately five millimeters to approximately 10 millimeters, such as approximately seven millimeters. In some aspects, distance 239 can be approximately one millimeter. In some aspects, the displacement of slider 230 can coincide with a displacement of slider member 240 and/or release 270. In some aspects, the displacement of slider member 240 can be an angle 245 relative to longitudinal axis 5. In some aspects, angle 245 can be between five degrees and 20 degrees, such as between seven degrees and 15 degrees, such as 10 degrees. In some aspects, the displacement of release 270 can be an angle 275 relative to a longitudinal axis 6 disposed on a plane coinciding with a bottom edge 271 of anchor 272. In some aspects, angle 275 can be between five degrees and 20 degrees, such as between seven degrees and 15 degrees, such as 10 degrees.

As shown in FIG. 11, in some aspects, slider 230 can move in a direction 2 from a second secured position with an anterior positioning to a first secured position with a posterior positioning. Similarly, in some aspects, slider 230 can move in a direction 3 from a first secured position with a posterior positioning to a second secured position with an anterior positioning. Accordingly, slider 230 can translate to adjust face shield 300 relative to the eyes of the wearer and/or helmet 100. In some aspects, slider 230 can rotate to adjust face shield 300 relative to the eyes of the wearer and/or helmet 100. In some aspects, slider 230 can translate and rotate to adjust face shield 300 relative to the eyes of the wearer and/or helmet 100.

As discussed above, helmet-shield adjustment system 1 can include an adjustment system 200 on either side 101 (FIG. 1). In some aspects, first and second sliders 230 of face shield 300 (FIGS. 1-2A) can move simultaneously in direction 2 and direction 3 between a first secured position and a second secured position. In some aspects, first and second sliders 230 can rotate to adjust face shield 300 relative to the eyes of the wearer and/or helmet 100. In some aspects, first and second sliders 230 can translate and rotate to adjust face shield 300 relative to the eyes of the wearer and/or helmet 100.

Figure 12:
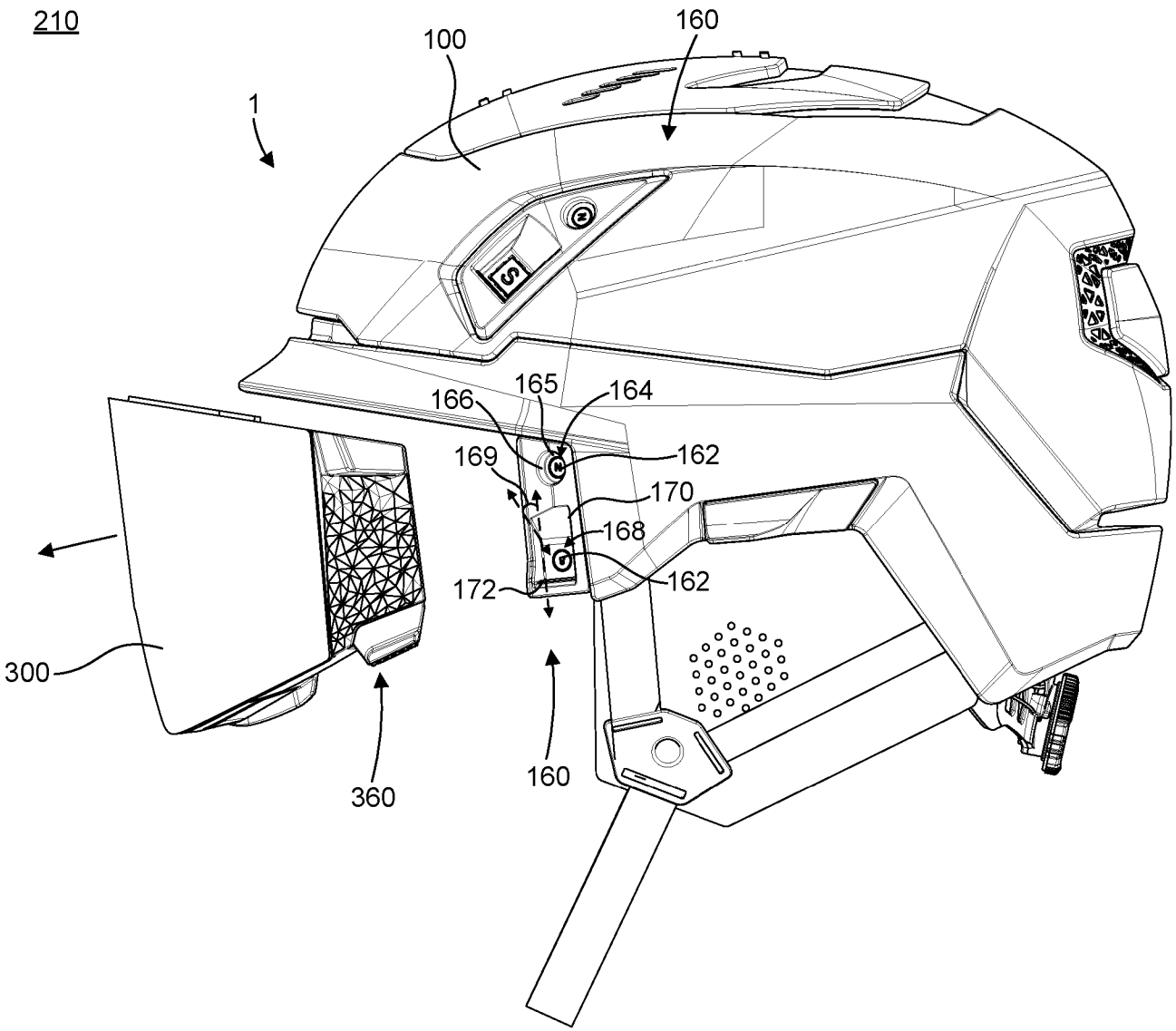
FIG. 12 shows a side view of the helmet-shield adjustment system of FIG. 1.

As shown in FIG. 12, helmet-shield adjustment system 1 can be in a detached position 10. In detached position 10, face shield 300 can be removed from helmet 100.

In some aspects, helmet 100 can include a shield attachment 160 for attaching and removing face shield 300 between engaged position 20 (FIG. 10) and detached position 10, respectively. In some aspects, shield attachment 160 can be a magnetic interface that includes one or more magnets 162. In some aspects, shield attachment 160 can include an upper recess 164 supported by an upper recess rim 165 and an upper recess wall 166. In some aspects, shield attachment 160 can also include a lower recess 168 supported by a first lower recess wall 170 and a second lower recess wall 172. In some aspects, upper recess wall 166 can be a round sidewall around upper recess rim 165. In some aspects, first lower recess wall 170 can extend at an angle 169 from lower recess 168 toward upper recess 164. In some aspects, second lower recess wall 172 can extend perpendicularly from lower recess 168. In some aspects, second lower recess wall 172 can also include a protrusion 174 (FIG. 14) that can extend inward into lower recess 168. In some aspects, magnet 162 can be disposed in each of upper recess 164 and lower recess 168.

Figure 13:
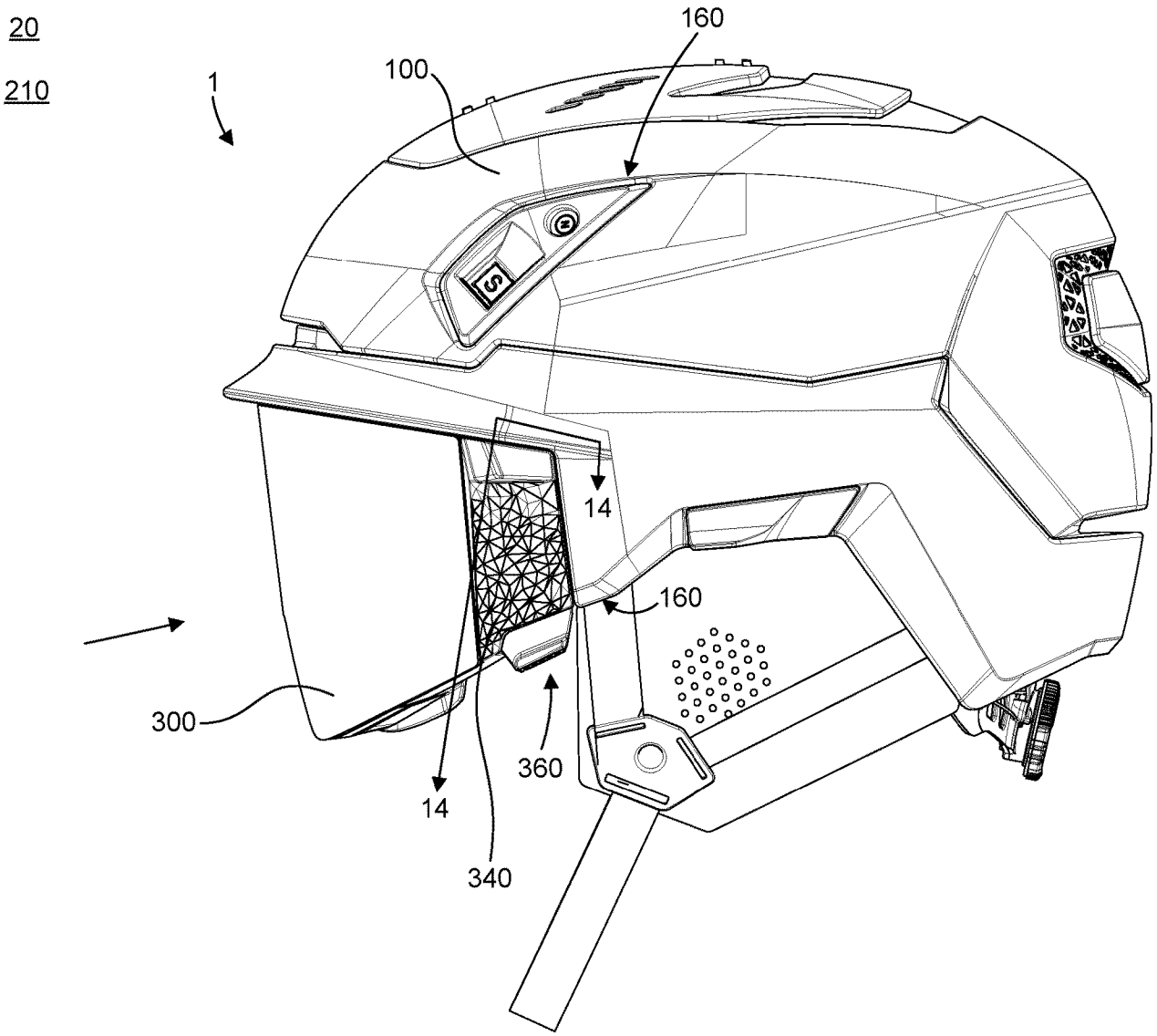
FIG. 13 shows a side view of the helmet-shield adjustment system of FIG. 1.

With reference to FIGS. 12-13, helmet-shield adjustment system 1 can move from detached position 10 (FIG. 12) to engaged position 20 (FIG. 13). As shown in FIG. 12, face shield 300 can include a helmet attachment 360. In some aspects, helmet attachment 360 can be a magnetic interface. Helmet attachment 360 can attach to shield attachment 160 to move helmet-shield adjustment system 1 from detached position 10 to engaged position 20.

Figure 14:
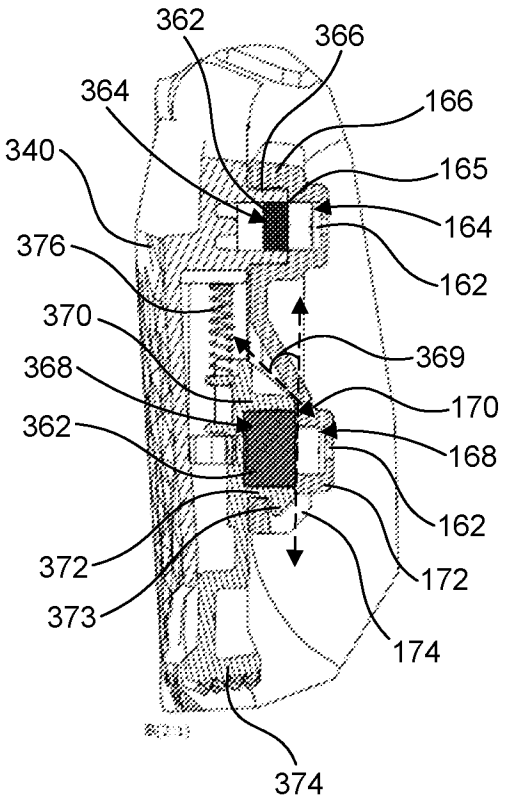
FIG. 14 shows a cutout view of the helmet-shield adjustment system of FIG. 13.
Figure 14:
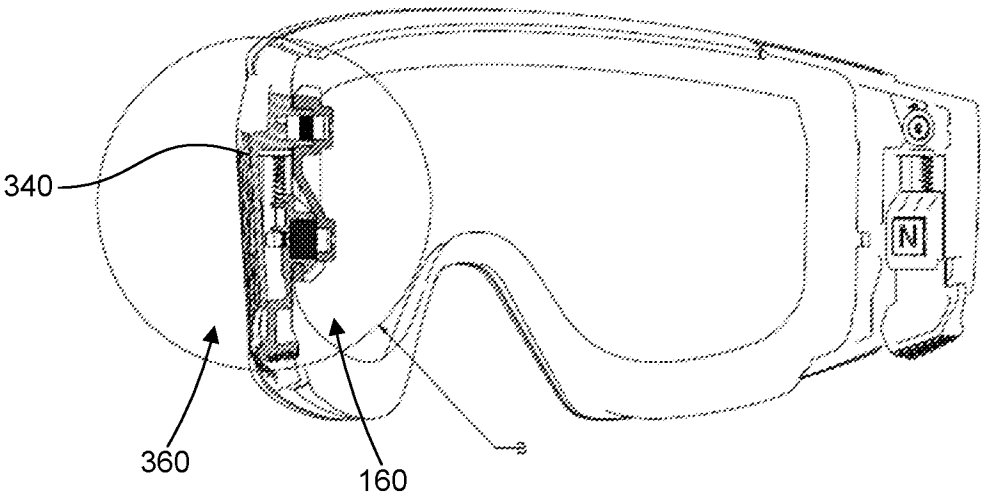

As shown in FIG. 14, in some aspects, helmet attachment 360 can be disposed on outrigger 340 of face shield 300. In some aspects, helmet attachment 360 can include one or more magnets 362. In some aspects, helmet attachment 360 can include an upper recess 364 supported by an upper recess wall 366. In some aspects, helmet attachment 360 can also include a lower recess 368 supported by a first lower recess wall 370 and a second lower recess wall 372. In some aspects, upper recess wall 366 can be a round sidewall for supporting upper recess 364. In some aspects, upper recess wall 366 can fit within upper recess 164 of shield attachment 160. In some aspects, first lower recess wall 370 can extend at an angle 369 from lower recess 368 toward upper recess 364. In some aspects, second lower recess wall 372 can extend perpendicularly from lower recess 368. In some aspects, second lower recess wall 372 can also include a protrusion 373 that can extend outward from lower recess 368. In some aspects, protrusion 373 can be received in second lower recess wall 172 of shield attachment 160 around protrusion 174, as shown in FIG. 14. In some aspects, a magnet 362 can be disposed in each of upper recess 364 and lower recess 368 of helmet attachment 360 to magnetically attach to magnets 162 of shield attachment 160.

Based on the foregoing, in some aspects, magnets 362 disposed in outrigger 340 of face shield 300 can attach face shield 300 to helmet 100. In some aspects, helmet attachment 360 can also include a release 374. In some aspects, release 374 can be a button or a lever accessible from outside face shield 300. In some aspects, release 374 can be biased such that magnet 162 disposed in lower recess 168 and magnet 362 disposed in lower recess 368 are attached. In some aspects, a spring 376 can be supported between upper recess wall 366 and first lower recess wall 370. In some aspects, spring 376 can bias release 374. In some aspects, release 374 can extend from second lower recess wall 372 such that actuating release 374 can compress spring 376. Compressing spring 376 can move release 374 away from its biased position. Moving release 374 attached to lower recess 368 can move lower recess 368 to interrupt the magnetic attachment between magnet 162 disposed in lower recess 168 and magnet 362 disposed in lower recess 368. Accordingly, the wearer can actuate release 374 to detach magnet 162 disposed in lower recess 168 from magnet 362 disposed in lower recess 368. In some aspects, the wearer can pull face shield 300 to detach magnet 162 disposed in upper recess 164 from magnet 362 disposed in lower recess 368. In this way, face shield 300 and helmet 100 can be detached from one another.

Figure 15:
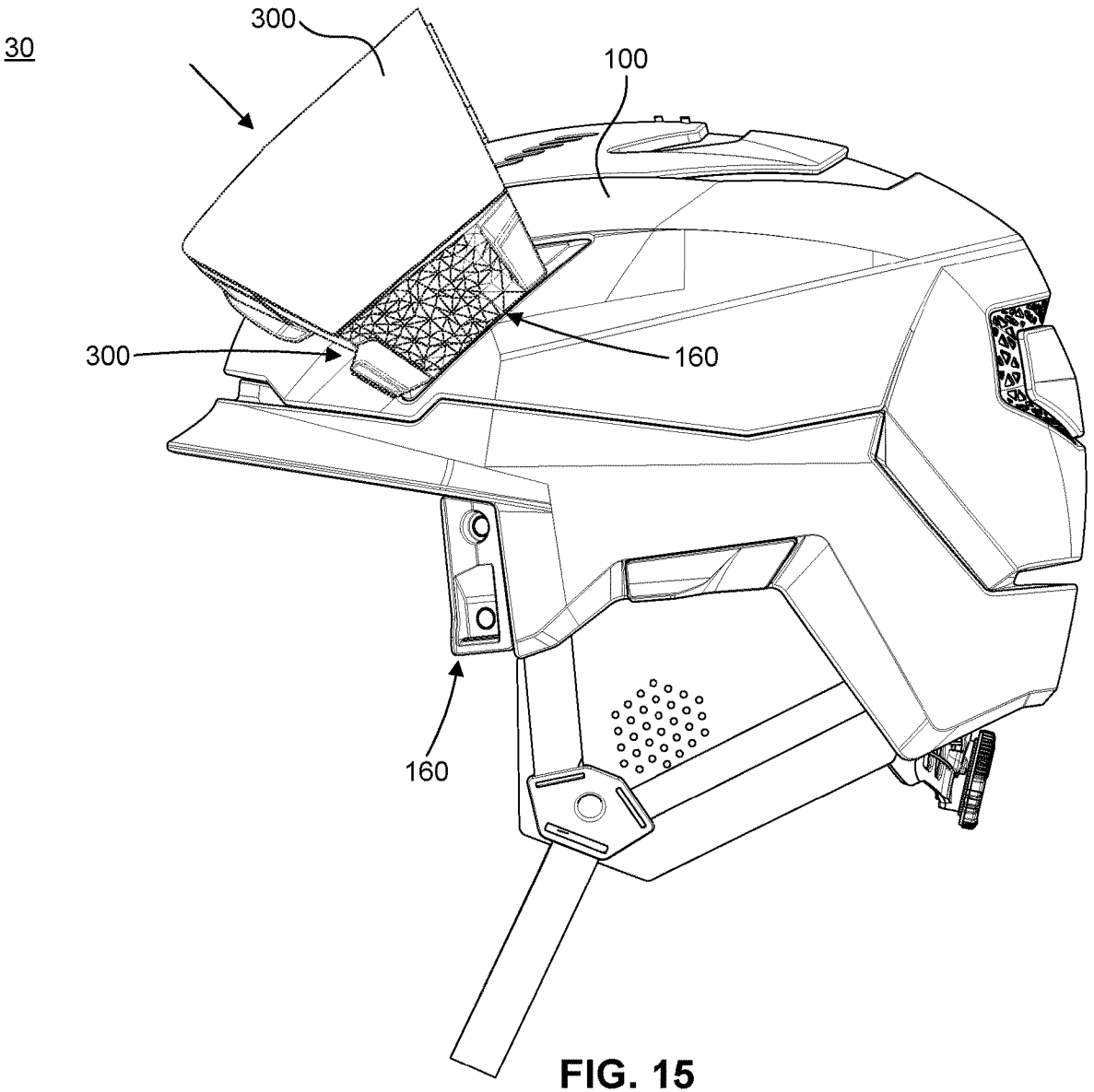
FIG. 15 shows a side view of the helmet-shield adjustment system of FIG. 1.

As shown in FIG. 15, helmet-shield adjustment system 1 can be in a stowed position 30. In some aspects, helmet 100 can include a second shield attachment 160 (FIGS. 12-13) for attaching and removing face shield 300 between stowed position 30 and detached position 10, respectively. Accordingly, helmet 100 can include a first shield attachment 160 to couple helmet 100 to face shield 300 in engaged position 20 (FIG. 13) and a second shield attachment 160 to couple helmet 100 to face shield 300 in stowed position 30. Stowed position 30 can secure face shield 300 to helmet 100 when not in engaged position 20. In this way, face shield 300 can be maintained with helmet 100 when not in an as-worn position.

As discussed above, in some aspects, face shield 300 and/or face shield 300' and components thereof can be oriented to have a rake or lens tilt (FIG. 4). In some aspects, frame 250 and/or slider 230 (and/or components thereof) can translate and/or rotate to move between a first secured position with a posterior positioning and a second secured position with an anterior positioning to provide a rake adjustment (FIGS. 3-4).

Figure 16:
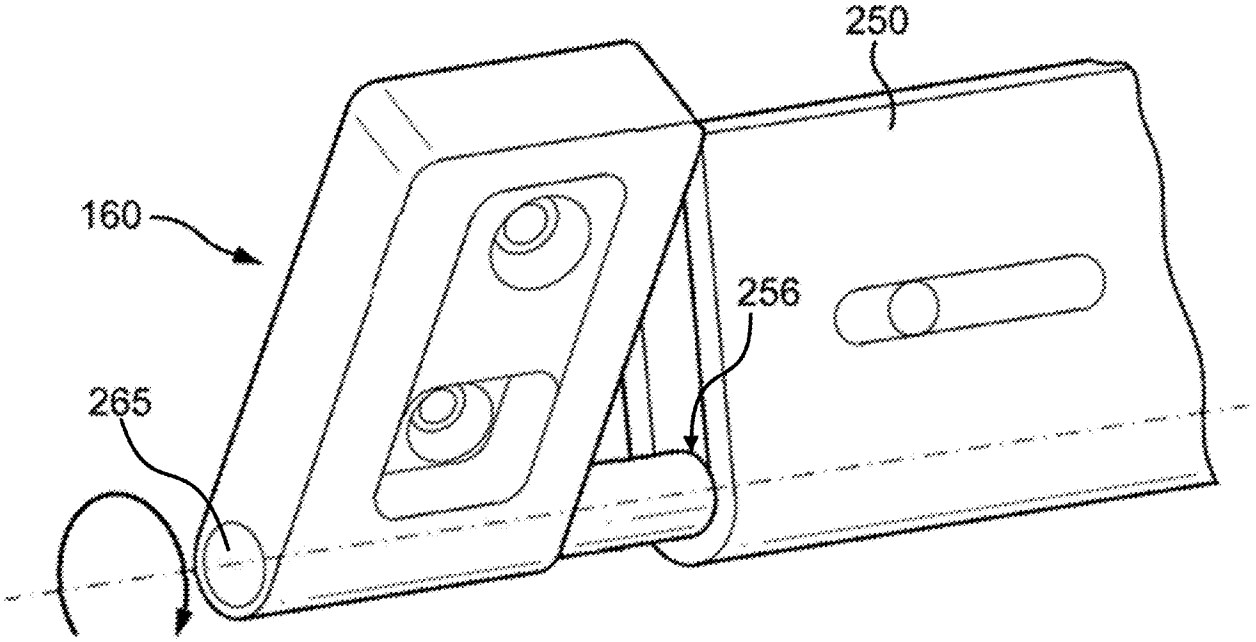
FIG. 16 shows an adjustment system according to aspects.
Figure 17:
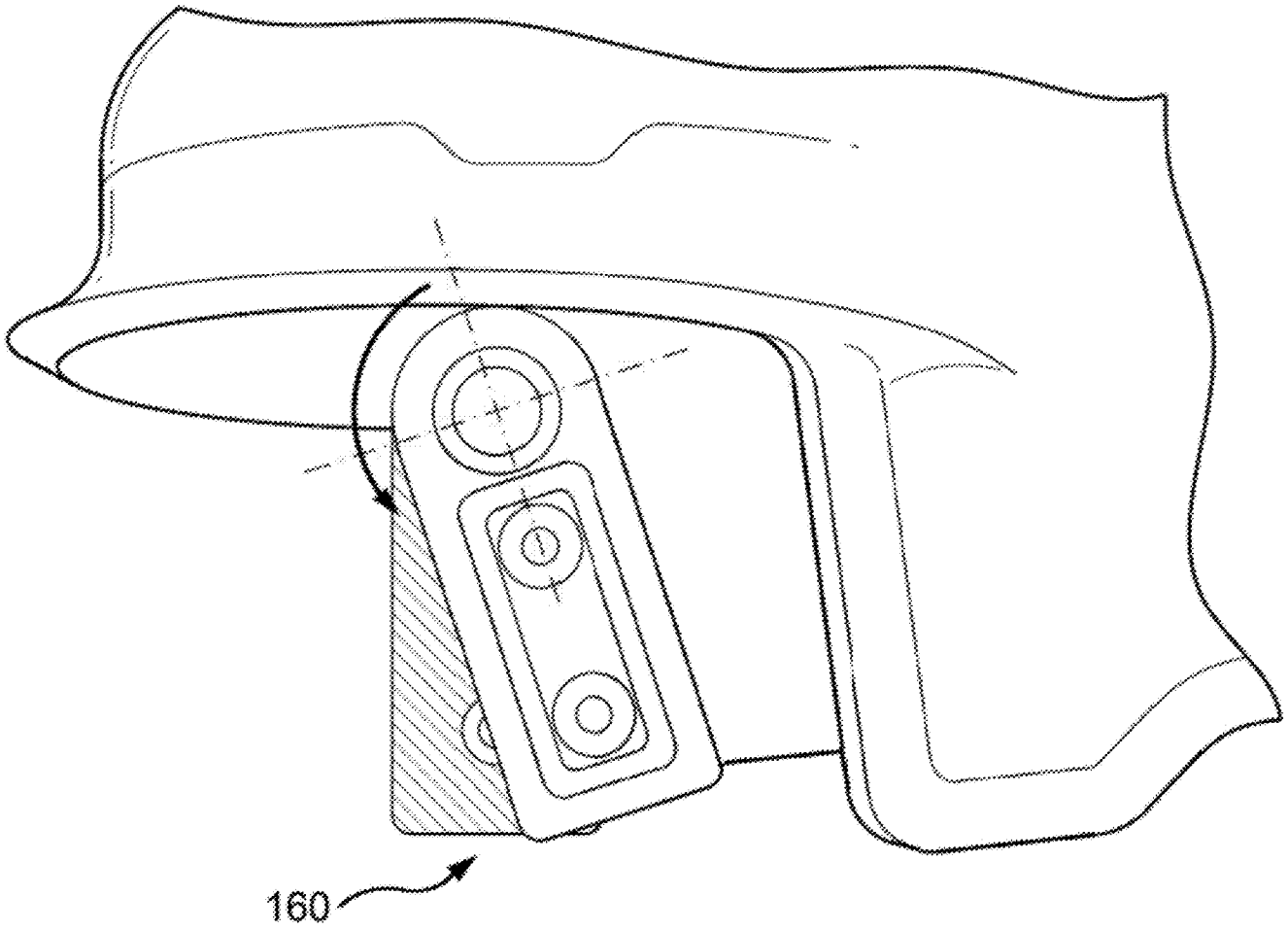
FIG. 17 shows an adjustment system according to aspects.

With reference to FIGS. 16-17, in some aspects, frame 250 and/or slider 230 (and/or components thereof) can translate or rotate relative to longitudinal axis 5 when release 270 is in actuated position 220 (FIG. 11). In this way, slider 230 and face shield 300 engaged with frame 250 via slider member 240 can be adjusted translationally and rotationally. In some aspects, shield attachment 160 can rotate to adjust face shield 300 rotationally. In some aspects, shield attachment 160 can rotate relative to frame 250. In some aspects, one or more slots on shield attachment 160 can guide rotation relative to frame 250. In some aspects, a protrusion moving within slot can fix shield attachment 160 and provide a rake or lens tilt. In some aspects, frame 250 can include a bar 265 extending across lower channel 256. In some aspects, slider 230 can be attached to frame 250 by receiving bar 265 in a corresponding opening 235. In some aspects, slider 230 can rotate about bar 265 to adjust rotationally. In some aspects, a rotating tool can be actuated to rotate frame 250, slider 230, and/or shield attachment 160. In some aspects, a rotating tool can translate a top end of face shield 300 to provide a rake or lens tilt.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventors, and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A face shield fit adjustment system, comprising:

a frame configured to attach to a helmet, the frame comprising a channel;

a face shield slider having integral teeth, the face shield slider configured to attach to a face shield and to translate within the channel of the frame while the face shield fit adjustment system is in an as-worn position between:

a first secured position such that the face shield is at a first distance from an eye of a wearer when attached to the face shield fit adjustment system in the as-worn position, and a second secured position such that the face shield is at a second distance from the eye of the wearer when attached to the face shield fit adjustment system in the as-worn position, the first distance being less than the second distance;

a release configured to disengage the face shield slider to translate the face shield slider between the first secured position and the second secured position; and the frame further comprising a frame member having teeth configured to selectively engage the integral teeth of the face shield slider in the first secured position and the second secured position.

2. The system of claim 1, wherein the face shield slider is configured to releasably attach to the face shield to adjust the face shield relative to the eye of the wearer.

3. The system of claim 1, wherein the face shield slider is biased to the first secured position.

4. The system of claim 1, wherein the frame member is configured to hold the face shield slider in the first secured position and the second secured position.

5. The system of claim 4, wherein a displacement of the face shield slider between the first secured position and the second secured position is less than a length of the frame member.

6. The system of claim 5, wherein the displacement is in a range of one millimeter to 15 millimeters.

7. The system of claim 5, wherein the displacement is approximately one millimeter.

8. The system of claim 1, further comprising:

a face shield slider member pivotally attached to other portions of the face shield slider at a first end of the face shield slider member, wherein the integral teeth of the face shield slider are part of the face shield slider member.

9. The system of claim 8, wherein a free end of the face shield slider member is configured to be coupled to the release.

10. The system of claim 8, wherein the face shield slider member is configured to rotate to move between the first secured position and the second secured position.

11. The system of claim 8, wherein the face shield slider member is biased to engage the frame member.

12. The system of claim 1, wherein the face shield slider comprises a protrusion that is configured to translate within the channel of the frame.

13. The system of claim 1, wherein the face shield slider is a first face shield slider and the frame is a first frame, the system further comprising:

a second frame configured to attach to the helmet, the second frame comprising a second channel; and a second face shield slider configured to attach to the face shield and to translate within the second channel of the second frame, wherein the first face shield slider is configured to translate with the second face shield slider between the first secured position and the second secured position.

14. A helmet-shield adjustment system comprising:

a face shield fit adjustment system, comprising:

a frame configured to attach to a helmet, the frame comprising a channel;

a face shield slider having integral teeth, the face shield slider configured to attach to a face shield and to translate within the channel of the frame while the face shield fit adjustment system is in an as-worn position between:

a first secured position such that the face shield is at a first distance from an eye of a wearer when attached to the face shield fit adjustment system in the as-worn position, and a second secured position such that the face shield is at a second distance from the eye of the wearer when attached to the face shield fit adjustment system in the as-worn position, the first distance being less than the second distance;

a release configured to disengage the face shield slider to translate the face shield slider between the first secured position and the second secured position; and the frame further comprising a frame member having teeth configured to selectively engage the integral teeth of the face shield slider in the first secured position and the second secured position;

the helmet;

and the face shield, wherein the face shield is adjustable with the face shield fit adjustment system to fit relative to the eye of the wearer.

15. The helmet-shield adjustment system of claim 14, the face shield comprising a lens, wherein a lens tilt of the lens changes up to five degrees between the first secured position and the second secured position when the face shield is attached to the face shield fit adjustment system in the as-worn position.

16. The helmet-shield adjustment system of claim 14, the face shield further comprising:

a magnet disposed in a recess of an outrigger of the face shield to attach the face shield to the helmet; and a magnet release, wherein the magnet release is configured to move the recess to detach the face shield from the helmet, and wherein the magnet release is biased to not move the recess.

17. The helmet-shield adjustment system of claim 14, the helmet comprising:

an upper shell;

the frame member attached to the frame to engage the face shield slider in the first secured position and the second secured position; and a lower shell attached to the release of the face shield fit adjustment system, the release moving from a first position to a second position to disengage the frame member from the face shield slider to translate the face shield slider between the first secured position and the second secured position, the frame being attached to the helmet.

18. The helmet-shield adjustment system of claim 17, wherein a bottom edge of the lower shell is coplanar with the release when the release is in the first position.

19. The helmet-shield adjustment system of claim 17, wherein the frame member is configured to translate relative to a longitudinal axis when the release is in the second position, the longitudinal axis being disposed on a plane coinciding with a top edge of the frame member.

20. The helmet-shield adjustment system of claim 17, wherein the teeth of the frame member comprise a top toothed edge to engage the face shield slider.

21. The helmet-shield adjustment system of claim 17, wherein the channel of the frame is bounded by a track of the frame to receive an upper end of the face shield slider.

22. The helmet-shield adjustment system of claim 17, further comprising:

a first magnetic interface to couple the helmet to the face shield in an engaged position; and a second magnetic interface to couple the helmet to the face shield in a stowed position, wherein the second magnetic interface comprises:

a magnet disposed in a recess of the upper shell.

23. A face shield fit adjustment system, comprising:

a first frame configured to attach to a helmet, the first frame comprising a first channel;

a first face shield slider configured to attach to a face shield and to translate within the first channel of the first frame while the face shield fit adjustment system is in an as-worn position between:

a first secured position such that the face shield is at a first distance from an eye of a wearer when attached to the face shield fit adjustment system in the as-worn position, and a second secured position such that the face shield is at a second distance from the eye of the wearer when attached to the face shield fit adjustment system in the as-worn position, the first distance being less than the second distance; and a release configured to disengage the first face shield slider to translate the first face shield slider between the first secured position and the second secured position, a second frame configured to attach to the helmet, the second frame comprising a second channel; and a second face shield slider configured to attach to the face shield and to translate within the second channel of the second frame, wherein the first face shield slider is configured to translate with the second face shield slider between the first secured position and the second secured position, and wherein the release is configured to disengage the first face shield slider and the second face shield slider simultaneously to translate the first face shield slider between the first secured position and the second secured position.

24. A face shield fit adjustment system, comprising:

a frame configured to attach to a helmet, the frame comprising a channel;

a face shield slider having integral teeth, the face shield slider configured to attach to a face shield and to move within the channel of the frame while the face shield fit adjustment system is in an as-worn position between:

a first secured position such that the face shield is at a first distance from an eye of a wearer when attached to the face shield fit adjustment system in the as-worn position, and a second secured position such that the face shield is at a second distance from the eye of the wearer when attached to the face shield fit adjustment system in the as-worn position, the first distance being less than the second distance;

a release configured to disengage the face shield slider to move the face shield slider between the first secured position and the second secured position; and the frame further comprising a frame member having teeth configured to selectively engage the integral teeth of the face shield slider in the first secured position and the second secured position, wherein the face shield slider is configured to move within the channel of the frame, when the frame is attached to the helmet, between the first secured position and the second secured position while maintaining the face shield below a brim of the helmet.

25. The face shield fit adjustment system of claim 24, wherein the face shield slider is configured to translate along a plane parallel to an anterior-posterior line while the face shield fit adjustment system is in the as-worn position, and wherein the anterior-posterior line extends within a sagittal plane between a posterior side to an anterior side of the wearer.

26. A helmet-shield adjustment system comprising:

a face shield fit adjustment system, comprising:

a frame configured to attach to a helmet, the frame comprising a channel;

a face shield slider configured to attach to a face shield and to move within the channel of the frame while the face shield fit adjustment system is in an as-worn position between:

a first secured position such that the face shield is at a first distance from an eye of a wearer when attached to the face shield fit adjustment system in the as-worn position, and a second secured position such that the face shield is at a second distance from the eye of the wearer when attached to the face shield fit adjustment system in the as-worn position, the first distance being less than the second distance; and a release configured to disengage the face shield slider to move the face shield slider between the first secured position and the second secured position, the helmet;

and the face shield, wherein the face shield slider is configured to move within the channel of the frame, when the frame is attached to the helmet, between the first secured position and the second secured position while maintaining the face shield below a brim of the helmet.

* * * * *